US008672024B2

(12) United States Patent
Tyler et al.

(10) Patent No.: US 8,672,024 B2
(45) Date of Patent: Mar. 18, 2014

(54) SUBSURFACE WELL COMPLETION SYSTEM HAVING A HEAT EXCHANGER

(75) Inventors: L. Don Tyler, Midland, TX (US); Ken W. Fryrear, Midland, TX (US); Michael C. Pierce, Erie, CO (US); Gary Allen Ring, Collinsville, TX (US)

(73) Assignee: Geotek Energy, LLC, Frisco, TX (US)

( * ) Notice: Subject to any disclaimer, the term of this patent is extended or adjusted under 35 U.S.C. 154(b) by 627 days.

(21) Appl. No.: 12/844,756

(22) Filed: Jul. 27, 2010

(65) Prior Publication Data

US 2011/0079380 A1 Apr. 7, 2011

Related U.S. Application Data

(63) Continuation-in-part of application No. 12/510,978, filed on Jul. 28, 2009, now Pat. No. 8,439,105.

(51) Int. Cl.
*E21B 36/00* (2006.01)

(52) U.S. Cl.
USPC ..... 166/57; 166/236; 166/242.1

(58) Field of Classification Search
USPC ..... 166/57, 236, 242.1
See application file for complete search history.

(56) References Cited

U.S. PATENT DOCUMENTS 3,187,814 A 6/1965 McCarthy
3,824,793 A 7/1974 Matthews
3,938,334 A 2/1976 Matthews
3,939,659 A 2/1976 Matthews
3,967,448 A 7/1976 Matthews
3,988,896 A 11/1976 Matthews
4,025,240 A 5/1977 Matthews
4,050,517 A 9/1977 Matthews
4,059,959 A 11/1977 Matthews
4,066,995 A 1/1978 Matthews
4,077,220 A 3/1978 Matthews
4,125,289 A 11/1978 Huff et al. ..... 299/4
4,140,176 A * 2/1979 Essebaggers ..... 165/134.1
4,142,108 A 2/1979 Matthews
4,325,681 A 4/1982 Matthews (Continued)

OTHER PUBLICATIONS

"Component Development", Sperry Low Temperature Geothermal Conversion System—Phase 1, Contract No. DE-AC03-78ET27125, Fig. 15 and Appendix H "Double Tubesheet Leak Test"; Harvey, C; McBee, W; and Matthews, H, Jul. 25, 1980.

(Continued)

*Primary Examiner* — Jennifer H Gay
*Assistant Examiner* — Elizabeth Gitlin
(74) *Attorney, Agent, or Firm* — Fitzpatrick, Cella, Harper & Scinto

(57) ABSTRACT

A subsurface well completion system including a subsurface heat exchanger section that includes an outer shell and an inner shell having an upper threaded portion, an open inside diameter, one or more inlet boxes and one or more outlet boxes. An upper annular ring extends between the inner shell and the outer shell and has one or more openings. A lower annular ring extends between the inner shell and the outer shell. The lower annular ring is spaced apart from the upper annular ring and has one or more openings. One or more tubes are sealably connected at a first end and a second end to the one or more openings in the upper annular ring and the one or more openings in the lower annular ring, respectively, and extend between the upper and lower annular rings in an annular space between the inner shell and the outer shell.

21 Claims, 23 Drawing Sheets

(56) References Cited

U.S. PATENT DOCUMENTS

| | | | | |
|---|---|---|---|---|
| 4,328,673 | A | 5/1982 | Matthews | |
| 4,342,197 | A | 8/1982 | Matthews | |
| 4,372,386 | A * | 2/1983 | Rhoades et al. | 166/300 |
| 4,377,763 | A | 3/1983 | Drake | 310/87 |
| 4,380,903 | A | 4/1983 | Matthews | |
| 4,388,807 | A | 6/1983 | Matthews | |
| 4,426,849 | A | 1/1984 | Matthews | |
| 4,566,532 | A | 1/1986 | Basmajian | |
| 4,605,977 | A | 8/1986 | Matthews | |
| 4,776,169 | A | 10/1988 | Coles, Jr. | 60/641.2 |
| 4,900,433 | A | 2/1990 | Dean et al. | |
| 5,052,482 | A | 10/1991 | Gondouin | 166/50 |
| 5,143,150 | A * | 9/1992 | Johnston | 165/45 |
| 5,579,838 | A | 12/1996 | Michael | |
| 5,816,325 | A | 10/1998 | Hytken | 166/303 |
| 5,862,866 | A | 1/1999 | Springer | |
| 6,073,448 | A | 6/2000 | Lozada | |
| 6,082,452 | A | 7/2000 | Shaw et al. | |
| 6,994,160 | B2 | 2/2006 | Wellington et al. | |
| 7,500,528 | B2 | 3/2009 | McKinzie et al. | |
| 2007/0071660 | A1 | 3/2007 | McGrew | 422/196 |

OTHER PUBLICATIONS

"Systems Description", Sperry Low Temperature Geothermal Conversion System—Phase 1, Contract No. DE-AC03-78ET27125, Matthews, H, Jan. 1, 1984.

Power Tube, Product Info, http://www.powertubeinc.com/product_info/, last retrieved on Dec. 27, 2011, archived Apr. 17, 2009, archived at http://web.archive.org/web/20090417174844/http://www.powertubeinc.com/product_info/, 2 pages.

Multi-Stage Pump In-Line (tandem) Versus Opposed Impeller Arrangements. Ekwestrel Corp., Engineering Consulting Services, Apr. 27, 2011. Last retrieved on Oct. 6, 2011, 2 pages.

PCT International Search Report and Written Opinion of the International Searching Authority, mailed Sep. 23, 2010 in PCT US2010/043439.

Notification Concerning Transmittal International Preliminary Report on Patentability and International Preliminary Report on Patentability for PCT/US2010/043439, mailed Feb. 9, 2012.

* cited by examiner

SUBSURFACE WELL COMPLETION SYSTEM HAVING A HEAT EXCHANGER

CROSS-REFERENCE TO RELATED APPLICATIONS

The present application is a continuation-in-part of co-pending U.S. patent application Ser. No. 12/510,978, filed Jul. 28, 2009, the contents of which are hereby incorporated by reference as if stated in full herein.

BACKGROUND

1. Field of the Invention

The present invention relates generally to subsurface equipment for wellbores and, more particularly, to subsurface equipment used to create separate annuli for production and working fluids.

2. Description of the Related Art

Wellbores are often provided with separate, multiple flow channels for moving fluids into and out of subsurface reservoirs. For example, a single injection well may be required to provide injection fluids to two or more layers in a reservoir, in which case two or more separate flow channels are required. As another example, a single wellbore may be used to provide both a means for producing fluid from a reservoir and also for providing a supply and return conduit for supplying a working fluid to a subsurface device.

One way of separating the flow channels is to use separate tubing strings in parallel and placed into a single wellbore. This method is useful for shallow wells having low flow rates but is impractical for wells having higher flow rates or deep wells where pressure drops caused by the required narrow tubing strings are unacceptable. Instead, concentric tubing strings are used, wherein one or more tubing strings are nested one inside another creating multiple annular flow channels defined by the inner wall of a first tubing string and the outer wall of a second tubing string passing through the annulus of the first tubing string. As the annular flow channels are separated by the tubing walls, the annular flow channels are isolated from one another in regard to pressure and the exchange of fluids. In addition, insulated tubing strings may also provide some thermal isolation between the annular flow channels.

One problem associated with concentric tubing strings is that the assignment of the fluids in each annular fluid channel is typically fixed. That is, once a fluid enters one of the annular flow channels, it must remain in that annular fluid channel and cannot be switched with fluid from another annular fluid channel. This may cause a problem, for example, when a subsurface device, such as turbine driven pump, needs to be placed in the wellbore and fluid needs to be routed to the device around another intervening device in the tubing string.

SUMMARY OF THE INVENTION

In view of the above, an aspect of the present invention is to provide a system in which separate subsurface components of a completed well may be serviced without pulling all of the subsurface components placed in the well to the surface. With conventional well completion techniques, it may be difficult to access the separate subsurface components independently.

The system enables fluids to be switched between annular flow channels within a wellbore and allows servicing of separate subsurface components installed in the wellbore.

In an embodiment of the present invention, a concentric tubing well completion system including a subsurface heat exchanger is provided. The well completion system creates concentric annular flow channels in a wellbore. The well completion system provides for switching fluid flow between the annular flow channels within the completed well. The well completion system can be used in conjunction with other subsurface equipment to more efficiently manage fluid flows in the completed well for the purposes of produced-fluid extraction and supply of a working fluid to a subsurface device. The subsurface heat exchanger includes threadably connected sections.

In one aspect of the invention, nesting tubing strings are arranged to create a concentric tubing string with independent annular flow channels from an underground fluid reservoir to ground level or above ground level. A separate device or flow loop is installed at the lower end of the concentric tubing string to create a pressure isolated, continuous flow loop from the surface end to the underground end of the concentric tubing string.

In another aspect of the invention, the heat exchanger can be mounted at any point in the concentric tubing string.

In another aspect of the invention, the system uses threaded joints with sliding seals at the lower end of the interior tubing strings to allow installation and extraction of the underground equipment with surface lifting equipment alone. No subsurface grappling or latching equipment is required.

In another aspect of the invention, the well completion system can be used with the subsurface heat exchanger such that fluid flowing in one annulus may be switched to flow into a different annulus. This allows changing the flow path of hot and cold fluid streams to facilitate certain operations in the completed well such as recovery of heat from a fluid stream or controlling the precipitation of solids by maintaining the temperature of a produced fluid.

In another aspect of the invention, the subsurface heat exchanger is composed of threadably connected sections. In one example of this aspect, an open inside diameter is provided through which other subsurface devices may pass, such as a subsurface turbine pump. In another example, seals are provided on the exterior of the heat exchanger in order to divert a wellbore fluid through heat exchanger elements.

This brief summary has been provided so that the nature of the invention may be understood quickly. A more complete understanding of the invention can be obtained by reference to the following detailed description of example embodiments in conjunction with the attached drawings.

DETAILED DESCRIPTION

Figure 1:
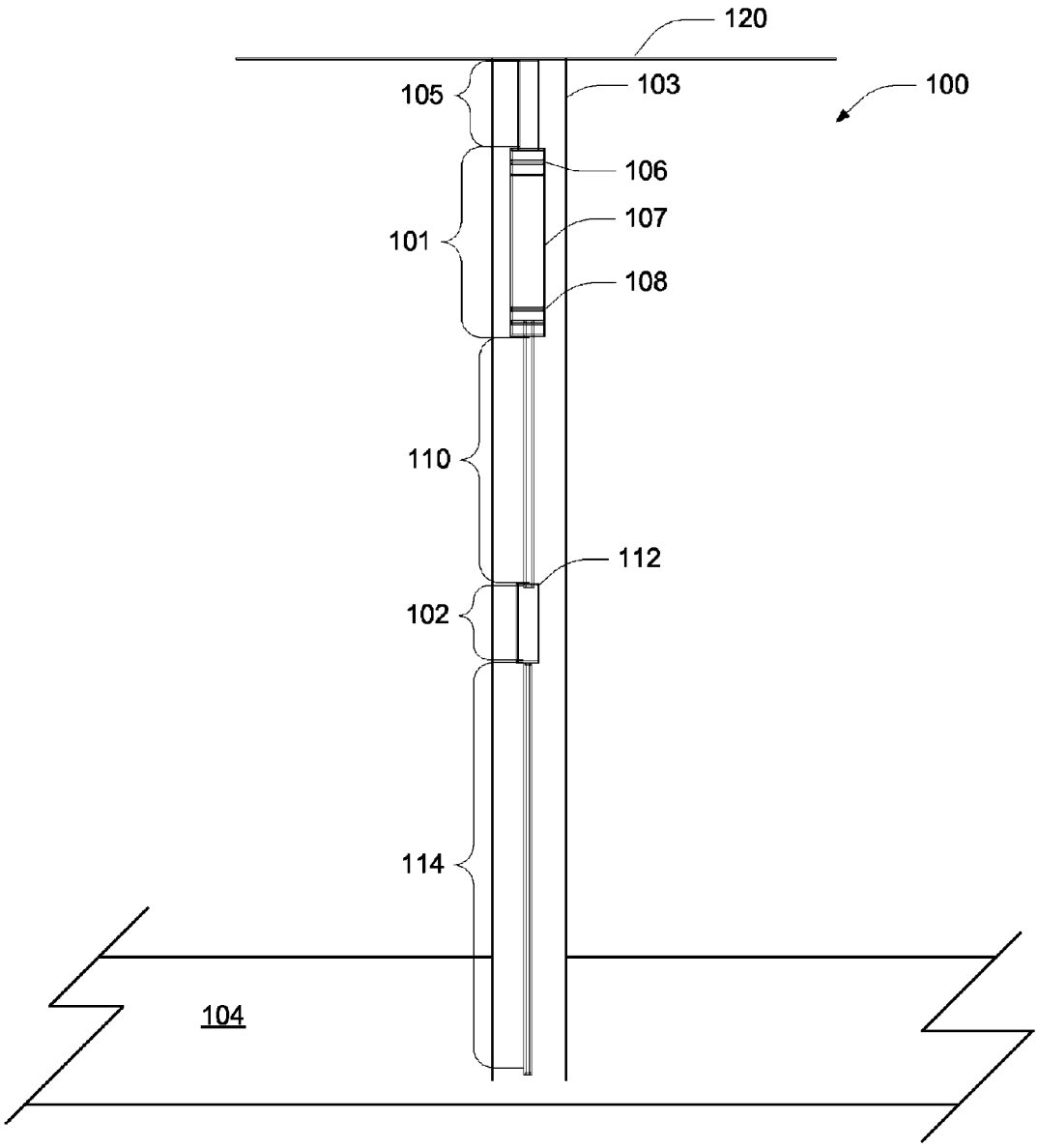
FIG. 1 is a longitudinal schematic diagram of a well completion system for a wellbore in accordance with an example embodiment of the invention.

FIG. 1 is a schematic diagram of a well completion system in accordance with an example embodiment of the invention. The well completion system 100 includes two subsurface sections, a heat exchanger section 101 and a fluidically powered pumping section 102, that extend into a well bore 103. The wellbore may be used for production of geothermally heated fluid from a subsurface production zone 104; however, it is to be understood that the well completion system is not limited to only geothermal applications.

The well completion system 100 uses concentric tubing strings having three concentric pipes or tubing strings to create independent flow paths above a fluidically powered pumping section 102 and below the surface 120. A separate device or flow loop can be installed at the lower end of the concentric tubing strings to create a pressure-isolated, continuous flow loop from the surface 120 to the underground end of the concentric tubing strings. The well completion system 100 uses annular flow crossovers (described below) that allow a fluid in any annular flow channel of the concentric tubing strings to be redirected into any other annular flow channel while maintaining the pressure and chemical integrity of the fluid. The annular flow crossovers are positionable at any point in the concentric tubing strings. Multiple annular flow crossovers may be installed downhole (for example, below the surface 120) to allow movement of the fluid from one annular flow channel to another as desired.

The well completion system 100 uses threaded joints with sliding seals at the lower end of the interior tubing strings of the concentric tubing strings to allow installation and extraction of the underground equipment with surface lifting equipment alone. No subsurface grappling or latching equipment is required. In an aspect of the embodiment, the well completion system 100 is structured in different sections, in which fluid flowing in one annular flow channel may be switched to flow into a different annular flow channel. This allows changing of the flow path of hot and cold fluid streams, for example. The well completion system 100 is usable to recover heat from a fluid stream, control solids precipitation by maintaining fluid temperature, etc.

The underground assembly includes sections of concentric tubing strings. An annular flow crossover is installed at the top and bottom of each intermediate section to redirect fluid flowing in one annular flow channel into a different annular flow channel, if desired. Each separate section is run by assembling joints of the outside tubing string with threaded connections at each end. The bottom section of the outside tubing string of a concentric tubing string supports any type of downhole device installed at the lower end of the tubing string. The device incorporates polished receptacles at the top of the device. These receptacles are structured to accept a seal assembly installed at the lower end of each interior tubing string. The interior tubing strings are installed after the outside tubing string is assembled and suspended in the hole. The concentric tubing strings are installed sequentially from the outer string toward the center string. The lower end of each interior tubing string with the seal installed at the end is assembled and additional sections added until the seal enters the receptacle at the bottom of the adjacent outer string.

The tubing string being run is suspended by a hanger assembly mounted on the inside of the outer tubing string. The top of each tubing string has a seal receptacle installed. This allows the installation of the annular flow crossover assembly with its seals to isolate each flow path. Subsequent sections can vary in design. Alternative design configurations include single or multiple heat exchanger sections, intermediate concentric tubing string sections, flow limiting sections, and pumping devices. These sections can be interspersed and placed at any intermediate depth in the well.

As shown in FIG. 1, the well completion system 100 includes a heat exchanger section 101 connected to an upper concentric tubing string section 105 that has a plurality of annular flow channels. The upper concentric tubing string section 105 is mechanically connected at a lower end to an upper annular flow crossover 106. The upper annular flow crossover 106 provides both mechanical and fluidic connectivity between the annular flow channels of the upper concentric tubing string section 105 and a heat exchanger 107. The heat exchanger 107 is connected at a lower end to a lower annular flow crossover 108. The lower annular flow crossover 108 mechanically and fluidically connects the heat exchanger 107 to a lower concentric tubing string section 110 that is connected to the fluidically powered pumping section 102. The lower concentric tubing string section 110 provides mechanical and fluidic connectivity between the lower flow crossover 108 and a fluidically driven pump 112. Optionally, the fluidically driven pump 112 is mechanically and fluidically connected to a tail pipe 114 that extends into the production zone 104.

The well completion system 100 and the concentric tubing strings can accommodate a working fluid that both drives the fluidically driven pump 112 and extracts heat from heated fluid produced from the production zone 104. To do so, downwardly flowing working fluid flows through a respective annular flow channel of the concentric tubing strings 105 and 110. Returning, upwardly flowing working fluid flows to the surface 120 through another respective annular flow channel of the concentric tubing strings 105 and 110. In addition, heated fluid produced from the production zone 104 flows through yet another annular flow channel of the concentric tubing strings 105 and 110.

In operation, the downwardly flowing working fluid flows by gravity or is pumped into the upper concentric tubing string section 105 down through the upper annular flow crossover 106, which routes the downwardly flowing working fluid into the heat exchanger 107. The downwardly flowing working fluid then flows out of the heat exchanger 107 and into the lower annular flow crossover 108, which routes the downwardly flowing working fluid to the fluidically driven pump 112. The fluidically driven pump 112 is driven by the downwardly flowing working fluid, which draws heated fluid from the production zone 104. The heated fluid is pumped toward the surface 120 along with the returning, upwardly flowing working fluid. The heated fluid and upwardly flowing working fluid travel up through the lower concentric tubing string section 110 in their separate respective concentric flow channels to the lower annular flow crossover 108. The lower annular flow crossover 108 routes the heated fluid into the heat exchanger 107 and the upwardly flowing working fluid through the heat exchanger 107. In the heat exchanger 107, heat is extracted from the heated fluid into the working fluid.

After leaving the heat exchanger 107, the heated fluid and the upwardly flowing working fluid are produced from the well at the surface 120. Once at the surface 120, the heated fluid is used to power a turbine that in turn drives an electric generator. The working fluid is then condensed and circulated back into the well completion system 100. Residual heat in the working fluid may also be extracted and used to power a turbine before the working fluid is circulated back into the well completion system 100.

As described herein, the well completion system 100 maintains a separated flow channel from the production zone 104 to the surface 120 for the heated fluid produced from the production zone 104. It is to be understood that the well completion system can be used to move heated fluid between different production and injection zones, from more than one production zone, into more than one injection zone, etc., as the well completion system 100 can accommodate additional intermediate openings into the tubing strings or well casing.

In other embodiments of the well completion system 100, the tail pipe 114 is dispensed with and an alternative completion arrangement is used at the bottom of the wellbore. The alternative completion arrangement can include an open hole completion, another concentric tubing string, etc.

Figure 2A:
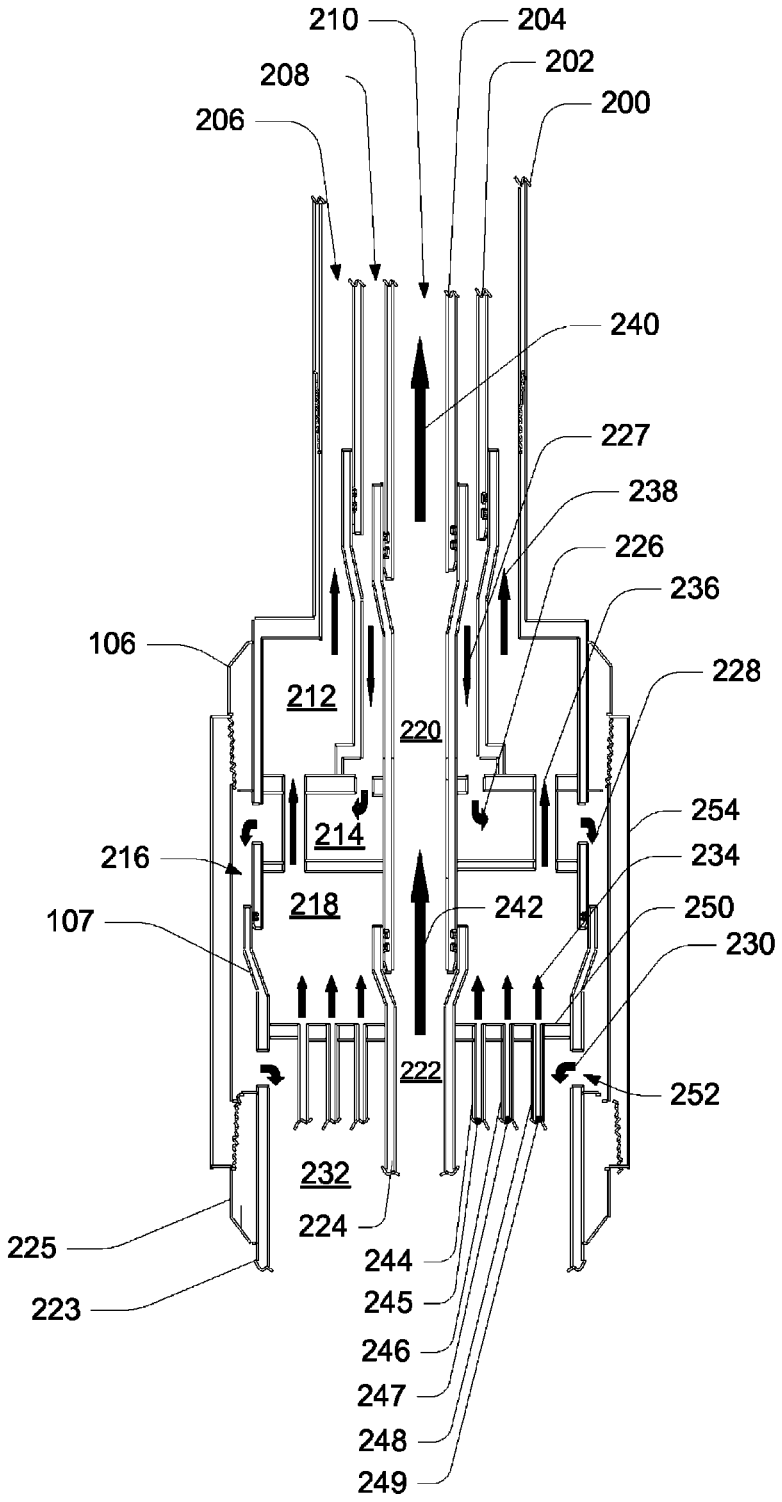
FIG. 2*a* is a longitudinal cross-sectional schematic drawing of an upper annular flow crossover and an upper portion of a subsurface heat exchanger in accordance with an example embodiment of the invention.

Individual components of the well completion system will now be described in greater detail with reference to FIGS. 2*a*, 2*b*, 2*c*, 3, and 4, where like-numbered elements refer to the same features illustrated in the figures. FIG. 2*a* is a longitudinal cross-sectional schematic drawing of an upper annular flow crossover in accordance with an example embodiment of the invention. The upper annular flow crossover 106 mechanically and fluidically connects the upper concentric tubing string section 105 to the subsurface heat exchanger 107. The concentric tubing string 105 has an outermost tubing string 200 and one or more concentric successive tubing strings, such as tubing strings 202 and 204. Each successive tubing string defines an annular flow channel between an inner surface of a preceding tubing string and an outer surface of the successive tubing string. For example, tubing strings 200 and 202 define one annular flow channel 206 therebetween and tubing strings 202 and 204 define another annular flow channel 208 therebetween. In addition, an innermost circular flow channel 210 is defined by an interior surface of the innermost tubing string 204. Therefore, successive flow channels are defined that succeed from an outermost tubing string flow channel 206 to an innermost tubing string flow channel 210.

The upper annular flow crossover 106 has one or more flow channels, such as flow channels 212 and 214, fluidically connecting a tubing string flow channel of the upper concentric tubing string section 105 to a non-corresponding flow channel in the heat exchanger 107. For example, the flow channel 214 connects the annular flow channel 208 to a relatively outer non-corresponding flow channel 216 of the heat exchanger 107. In addition, the flow channel 212 connects the annular flow channel 206 to a relatively inner non-corresponding flow channel 218 of the heat exchanger 107.

In addition, the annular flow crossover 106 may have one or more flow channels that fluidically couple a corresponding flow channel of the upper tubing string 105 to the heat exchanger 107. For example, the flow channel 210 of the concentric tubing string 105 is connected to a central flow channel 222 of the heat exchanger 107 via a flow channel 220 of the upper annular flow crossover 106.

In an embodiment of the annular flow crossover 106 in accordance with the invention, the annular flow crossover 106 is threadably connected to the outermost tubing string 200 and to an outer tube 223 of the heat exchanger 107. In addition, the annular flow crossover 106 is slidably and rotatably coupled to the successive tubing strings, such as tubing strings 202 and 204, of the upper concentric tubing string section 105 and an inner tube 224 of the heat exchanger 107.

The heat exchanger 107 includes an inner tube 224 within an outer tube 223. The annular flow channel 232 between the inner tube 224 and the outer tube 223 has one or more heat exchange tubes, such as heat exchange tubes 244, 246, and 248, passing therethrough. The heat exchange tubes, such as heat exchange tubes 244, 246, and 248, define one or more isolated internal flow channels, such as internal flow channels 245, 247 and 249, through the heat exchanger 107. The heat exchange tubes, such as heat exchange tubes 244, 246, and 248, are installed and sealed at an upper plate 250 and a lower plate (not shown) located at a respective each end of the inner tube 224 and the outer tube 223, thus creating a shell and tube exchanger. A fluid stream flowing through the heat exchange tubes, such as heat exchange tubes 244, 246, and 248, is isolated from a fluid flowing in the annular flow channel 232. A shell side of the heat exchanger 107 is thus defined as the flow channel 232 between the inner tube 224 and the outer tube 223 and external to the heat exchange tubes, such as heat exchange tubes 244, 246, and 248.

Fluid that flows through the shell side of the heat exchanger 107 flows into one or more ports, such as a port 252, cut in a side of the outer tube 223 and through the annular flow channel 216 between an outside surface of the outer tube 223 and a concentric threaded collar 254 that threadably connects the upper annular flow crossover 106 to the heat exchanger 107 via a sealing collar 225 on an exterior surface of the outer tube 223. The concentric threaded collar 254 provides both a structural connection and a pressure tight seal between the upper annular flow crossover 106 and the heat exchanger 107.

In operation, the upper annular flow crossover 106 receives downwardly flowing working fluid (as indicated by flow arrows 226, 227, 228, and 230) from the annular flow channel 208 and routes the downwardly flowing working fluid to the flow channel 216 of the heat exchanger 107 via the flow channel 214. The downwardly flowing working fluid then flows into the flow chamber 232 of the heat exchanger 107.

In addition, the upper annular flow crossover 106 receives upwardly flowing heated fluid (as indicated by flow arrows 234, 236, and 238) from the heat exchanger 107 and routes the upwardly flowing heated fluid from the flow channel 218 of the heat exchanger to the flow channel 206 of the upper concentric tubing string section 105. While in the heat exchanger 107, heat is transferred from the heated fluid to the downwardly flowing working fluid.

The upper annular flow crossover 106 also receives upwardly flowing heated working fluid (as indicated by flow arrows 240 and 242) from the heat exchanger 107. The upper annular flow crossover 106 routes the upwardly flowing working fluid into the innermost flow channel 210 of the concentric tubing string 105 from the flow channel 222 of the heat exchanger 107 by the flow channel 220 of the upper annular flow crossover 106.

In an embodiment of the annular flow crossover 106 in accordance with an aspect of the invention, the working fluid flows downwardly through the annular flow channel 206, the flow channel 212, and the flow channel 218 of the heat exchanger 107 such that the working fluid flows into heat exchange tubes, such as the heat exchange tubes 244, 246, and 248, of the heat exchanger 107. In addition, the heated fluid flows upwardly through the flow channel 232, the annular flow channel 216, the flow channel 214, and the annular flow channel 208.

Figure 2B:
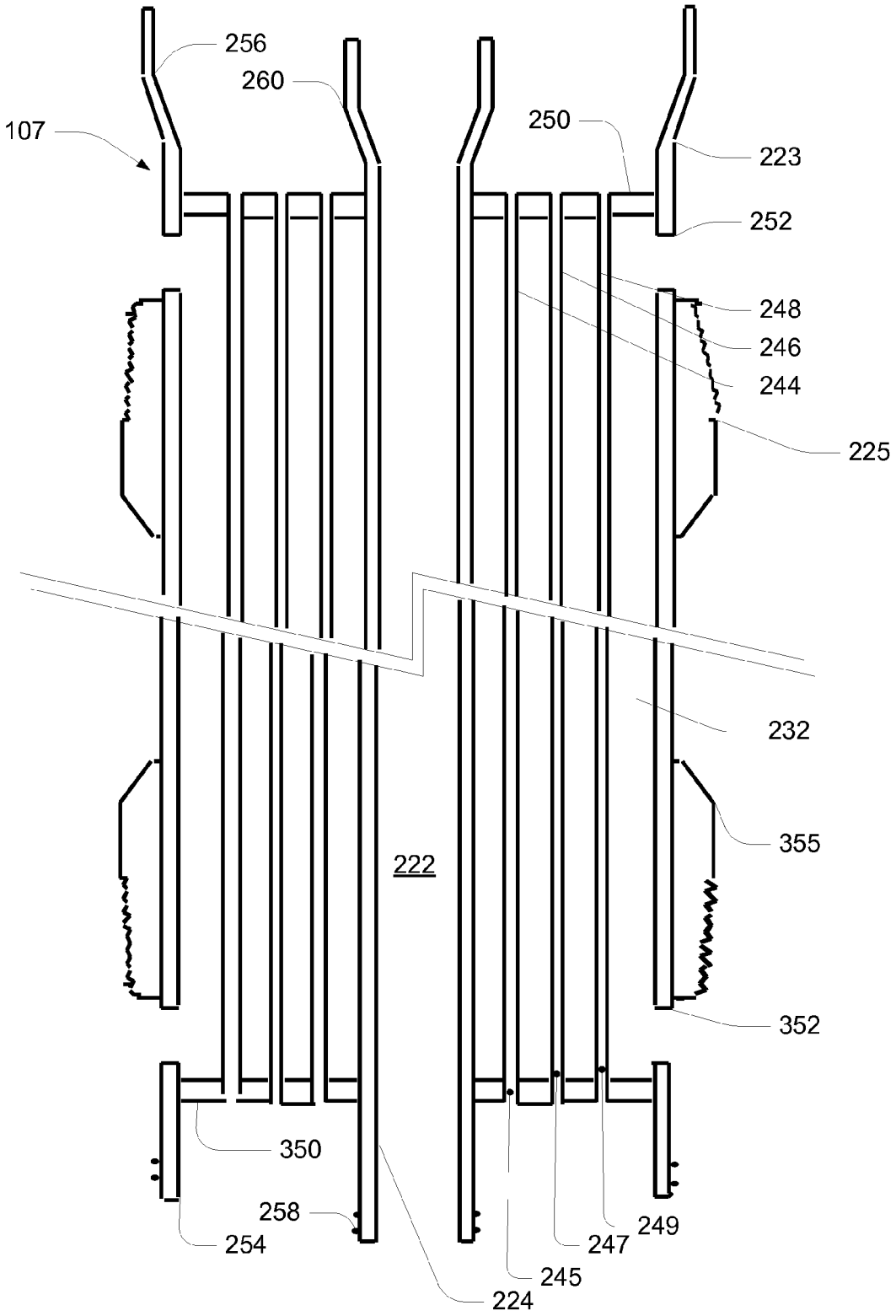
FIG. 2*b* is a longitudinal cross-sectional schematic drawing of a subsurface heat exchanger section in accordance with an example embodiment of the invention.

FIG. 2*b* is a longitudinal cross-sectional schematic diagram of the heat exchanger 107 in accordance with an example embodiment of the invention. As previously described, the heat exchanger 107 includes the inner tube 224 within the outer tube 223. An inner surface of the inner tube 224 defines the central flow channel 222. The annular flow channel 232 is defined between an outer surface of the inner tube 224 and the inner surface of outer tube 223. The annular flow channel 232 has one or more heat exchange tubes, such as the heat exchange tubes 244, 246, and 248, passing therethrough. The heat exchange tubes, such as 244, 246 and 248, define one or more isolated internal flow channels, such as the internal flow channels 245, 247 and 249, through the heat exchanger 107. The heat exchange tubes, such as 244, 246 and 248, are installed and sealed at the upper plate 250 and the lower plate 350 located at a respective each end of the inner tube 224 and the outer tube 223, thus creating the shell and tube exchanger. Fluid that flows through the annular flow channel 232 of the heat exchanger 107 flows through one or more ports, such as the ports 252 and 352, cut in a side of the outer tube 223.

The outer tube 223 has a sealing assembly 254 and a receptacle 256 for receiving a sealing assembly located at respective ends of the outer tube 223. The inner tube 224 is similarly constructed as inner tube 223 and also has a sealing assembly 258 and a receptacle 260 for receiving a sealing assembly located at respective ends.

Respective upper and lower sealing collars 225 and 355 are located on an exterior surface of the outer tube 223. The sealing collars 225 and 355 are used to threadably connect the heat exchanger 107 to a tubing string or an annular flow crossover using a concentric threaded collar, as previously described. The sealing collars 225 and 355 may be separate components that are connected to the exterior surface of the outer tube 223 or may be part of a machined assembly that incorporates the other features of an end portion of outer tube 223, such as the sealing assembly 254, the receptacle 256, the port 352, the port 252, etc., as may be desired.

Figure 2C:
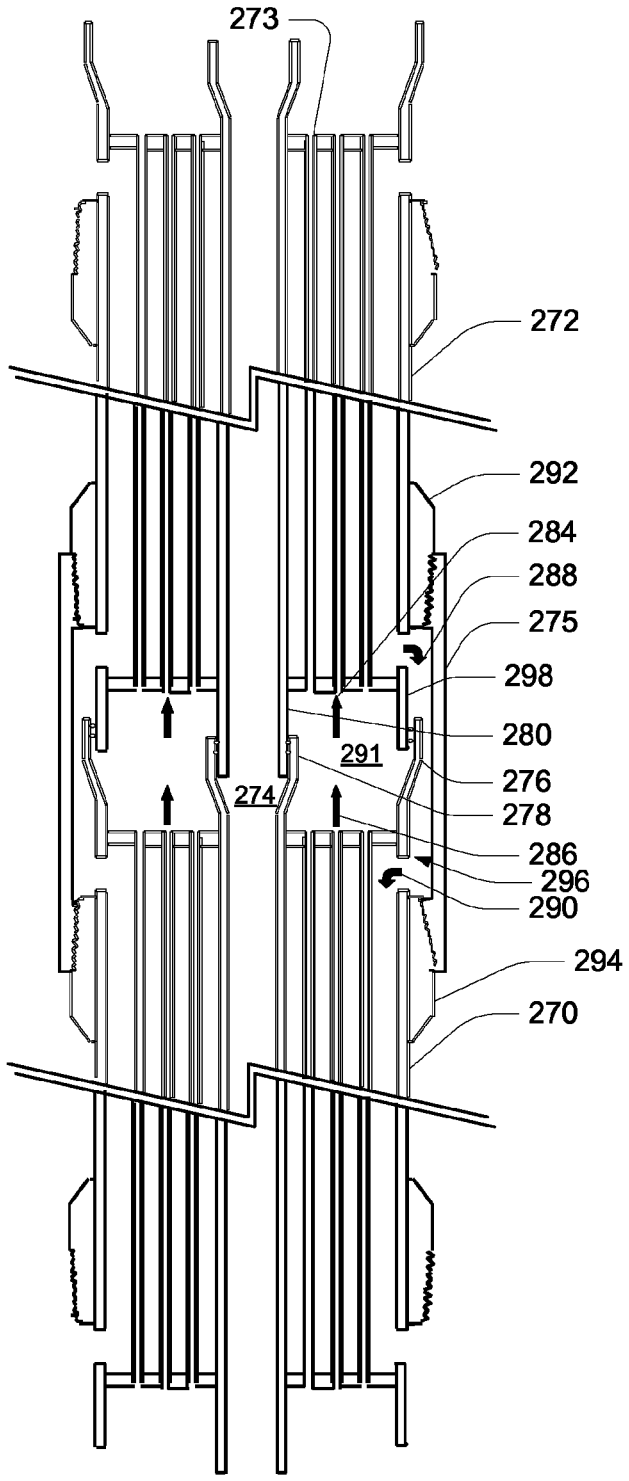
FIG. 2*c* is a longitudinal cross-sectional schematic drawing of two subsurface heat exchanger sections joined together in accordance with an example embodiment of the invention.

FIG. 2*c* is a longitudinal cross-sectional schematic drawing of two heat exchangers joined together in accordance with an example embodiment of the invention. In an aspect of this embodiment, any number of heat exchangers, such as heat exchangers 270 and 272, may be assembled sequentially in a wellbore in the same way as normal oil field casing or tubing. The flow paths for fluid flowing through heat exchanger tubes, such as heat exchanger tube 273, and a central flow channel 274 are isolated using a stab-in type of seal assembly and receptacle, such as seal assembly 280 and receptacle 278 for the central flow channel 274, and seal assembly 298 and receptacle 276 for the flow flowing through the heat exchanger tubes, heat exchanger tube 273. Such a sealing mechanism provides a seal to prevent any fluid cross flow between the other flow paths.

The combined heat exchangers 270 and 272 are joined together by a threaded concentric collar 275 that mates with a first sealing collar 292 and a second sealing collar 294. The threaded concentric collar 275 forms a flow channel 296 around the mated outer sealing assembly 298 and the respective receptacle 276. The flow channel 296 provides a flow channel for fluid flowing through a shell side of the combined heat exchangers 270 and 272, as indicated by flow arrows 288 and 290. In addition, a flow channel 291 is provided for fluid flowing through a tube side of the combined heat exchangers 270 and 272, as indicated by flow arrows 284 and 286.

The combined heat exchangers 270 and 272 can be supplied with or without a concentric coupling collar 275 already assembled to one end of the heat exchangers 270 and 272. Assembly of the concentric coupling collar 275 and heat exchangers 270 and 272 can thus be accomplished at a well site using standard oil field equipment.

As depicted in FIGS. 2*a*, 2*b* and 2*c*, the sealing assemblies and corresponding receptacles are configured such that connection of each sealing assembly with its corresponding receptacle occurs prior to contact of the coupling. In other embodiments of heat exchangers, a sealing assembly and its corresponding receptacle may be connected after threading of a sealing collar with a threaded concentric collar has begun.

Figure 3:
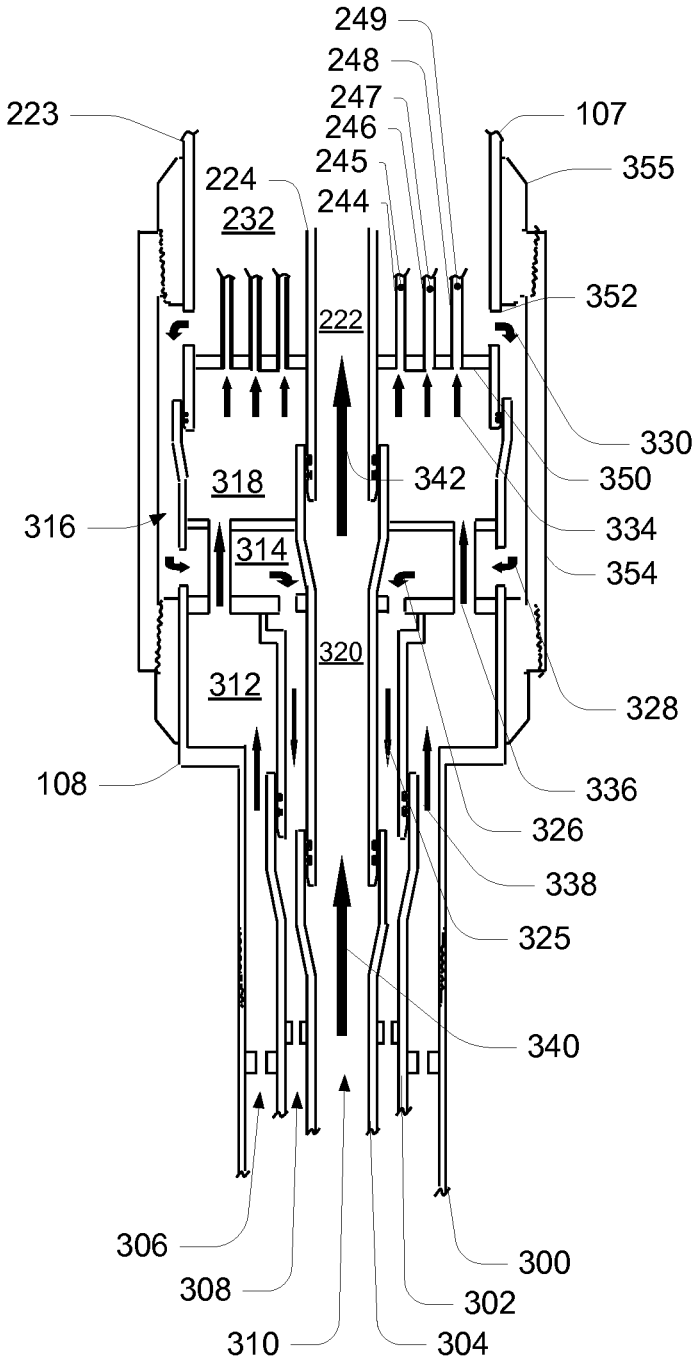
FIG. 3 is a longitudinal cross-sectional schematic drawing of a lower annular flow crossover and a lower portion of a subsurface heat exchanger in accordance with an example embodiment of the invention.

FIG. 3 is a longitudinal cross-sectional schematic drawing showing the lower annular flow crossover 108 in accordance with an example embodiment of the invention. The lower annular flow crossover 108 mechanically and fluidically connects the lower concentric tubing string section 110 to the subsurface heat exchanger 107. The lower concentric tubing string section 110 has an outermost tubing string 300 and one or more concentric successive tubing strings, such as tubing strings 302 and 304. Each successive tubing string defines an annular flow channel between an inner surface of a preceding tubing string and an outer surface of the successive tubing string. For example, the tubing strings 300 and 302 define an annular flow channel 306 therebetween and tubing strings 302 and 304 define another annular flow channel 308 therebetween. In addition, an innermost circular flow channel 310 is defined by an interior surface of the innermost tubing string 304. Therefore, a number of successive flow channels are defined that succeed from the outermost tubing string flow channel 306 to the innermost tubing string flow channel 310.

The lower annular flow crossover 108 has one or more flow channels, such as flow channels 312 and 314, fluidically connecting a tubing string flow channel of the lower concentric tubing string section 110 to a non-corresponding flow channel in the heat exchanger 107. For example, the flow channel 312 connects the annular flow channel 306 to a relatively inner non-corresponding flow channel 318 of the heat exchanger 107. In addition, the flow channel 314 connects the annular flow channel 308 to a relatively outer non-corresponding flow channel 316 of the heat exchanger 107.

In addition, the lower annular flow crossover 108 may have one or more flow channels that fluidically couple a corresponding flow channel of the lower tubing string 110 to the heat exchanger 107. For example, the flow channel 310 of the lower concentric tubing string section 110 is connected to the central flow channel 222 of the heat exchanger 107 via a flow channel 320 of the lower annular flow crossover 108.

In an embodiment of the lower annular flow crossover 108 in accordance with the invention, the lower annular flow crossover 108 is threadably connected to the outermost tubing string 300 and to the outer tube 223 of the heat exchanger 107. In addition, the annular flow crossover 108 is slidably and rotatably coupled to successive tubing strings, such as tubing strings 302 and 304, of the lower concentric tubing string section 110 and the inner tube 224 of the heat exchanger 107.

As previously described, the heat exchanger 107 includes the inner tube 224 within the outer tube 223. The annular flow channel 232 between the inner tube 224 and the outer tube 223 has one or more heat exchange tubes, such as the heat exchange tubes 244, 246 and 248, passing therethrough. The heat exchange tubes, such as the heat exchange tubes 244, 246 and 248, are installed and sealed at an upper plate (not shown) and the lower plate 350 located at a respective end of the inner tube 224 and the outer tube 223, thus creating a shell and tube heat exchanger. A fluid stream flowing through the heat exchange tubes, such as the heat exchange tubes 244, 246 and 248, is isolated from a fluid flowing in the annular flow channel 232. A shell side of the heat exchanger 107 is thus defined as the flow channel 232 between the inner tube 224 and the outer tube 223 and external to the heat exchange tubes, such as the heat exchange tubes 244, 246 and 248.

Fluid that flows through the shell side of the heat exchanger 107 flows through one or more ports, such as a port 352, cut in a side of the outer tube 223 and through the annular flow channel 316 between the outside surface of the outer tube 223 and a concentric threaded collar 354 that threadably connects the lower annular flow crossover 108 to the heat exchanger 107 via a sealing collar 355 on the exterior surface of the outer tube 223. The concentric threaded collar 354 provides both a structural connection and a pressure tight seal between the lower annular flow crossover 108 and the heat exchanger 107.

In operation, the lower annular flow crossover 108 receives upwardly flowing heated fluid (as indicated by flow arrows 334, 336, and 338) from the flow channel 306 of the lower concentric tubing string section 110 and routes the heated fluid via the flow channel 312 into the flow channel 318 of the heat exchanger 107. While in the heat exchanger 107, heat is transferred from the heated fluid to the downwardly flowing working fluid.

In addition, the lower annular flow crossover 108 receives downwardly flowing working fluid (as indicated by flow arrows 325, 326, 328, and 330) from the flow channel 316 of the heat exchanger 107 and routes the downwardly flowing working fluid to the flow channel 308 of the lower concentric tubing string section 110 via the flow channel 314.

The lower annular flow crossover 108 also receives upwardly flowing expanded working fluid (as indicated by flow arrows 340 and 342) from the lower concentric tubing string section 110. The lower annular flow crossover 108 routes the upwardly flowing heated working fluid from the innermost flow channel 310 of the lower concentric tubing string section 110 to the flow channel 222 of the heat exchanger 107 by the flow channel 320 of the lower annular flow crossover 108.

In an embodiment of the lower annular flow crossover 108 in accordance with an aspect of the invention, the working fluid flows downwardly through the flow channel 318 of the heat exchanger 107, the flow channel 312, and the annular flow channel 306. In addition, the heated fluid flows upwardly through the annular flow channel 308, the annular flow channel 316, and the annular flow channel 232.

Figure 4:
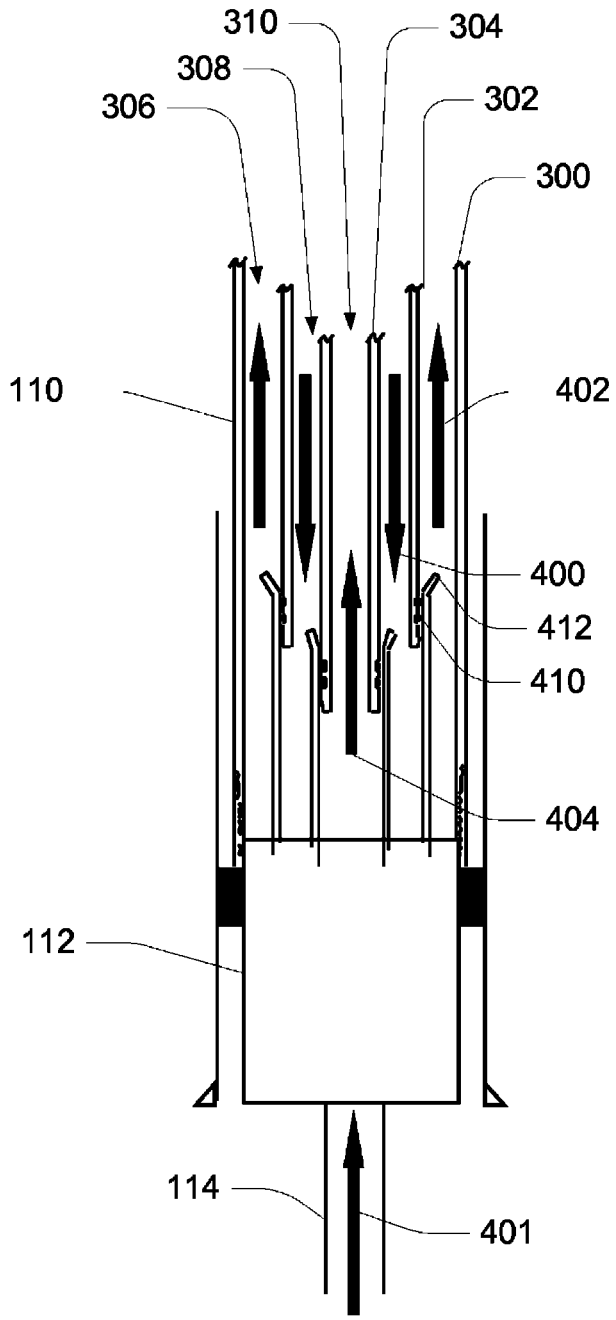
FIG. 4 is a longitudinal cross-sectional schematic drawing of a subsurface fluidically driven pump in accordance with an example embodiment of the invention.

FIG. 4 is a longitudinal cross-sectional schematic drawing showing the subsurface fluidically driven pump 112 in accordance with an example embodiment of the invention. The fluidically driven pump 112 is mechanically and fluidically connected to the lower concentric tubing string section 110. As previously described, the lower concentric tubing string section 110 includes the outermost tubing string 300 and one or more concentric successive tubing strings, such as tubing strings 302 and 304. Each successive tubing string defines an annular flow channel between an inner surface of a preceding tubing string and an outer surface of the successive tubing string. For example, the tubing strings 300 and 302 define the annular flow channel 306 therebetween and tubing strings 302 and 304 define the annular flow channel 308 therebetween. In addition, the innermost annular flow channel 310 is defined by the interior surface of the innermost tubing string 304. Therefore, a number of successive annular flow channels are defined that succeed from the outermost tubing string flow channel 306 to the innermost tubing string flow channel 310. A seal assembly, such as seal assembly 410, is mounted at the lower end of each concentric tubing string. Each seal assembly 410 on each concentric tubing string is slipped into a seal receptacle, such as seal receptacle 412.

The fluidically driven pump 112 is further coupled to the tail pipe 114 that has a lower opening (not shown) in communication with a reservoir of heated fluid. In operation, downwardly flowing working fluid (as indicated by flow arrow 400) flows into the fluidically driven pump 112 from the annular flow channel 308 of the lower concentric tubing string section 110. The fluidically driven pump 112 is then driven by the working fluid and takes in heated fluid (as indicated by flow arrow 401) from tail pipe 114 and pumps the heated fluid (as indicated by flow arrow 402) upwardly through the annular flow channel 306 of the lower concentric tubing string section 110. After driving the fluidically driven pump 112, the working fluid flows (as indicated by flow arrow 404) upwardly through the flow channel 310 of the lower concentric tubing string section 110.

In the foregoing description, the outermost annular flow channel in the concentric tubing strings 105 and 110 is depicted as containing heated fluid, the next successive annular flow channel is depicting as containing downwardly flowing working fluid, and the innermost flow channel is depicted as containing upwardly flowing working fluid. However, in various other embodiments of the invention, the order and assignment of flow channels can be altered in accordance with the needs of the fluids being conveyed as the order and assignment is arbitrarily selectable. Furthermore, the order and assignment of the flow channels may be altered such that different sections of concentric tubing strings have a different order and assignment. In addition, in the foregoing description only three flow channels are depicted. In other embodiments of the invention, fewer or more flow channels may be provided.

An assembly procedure for the well completion system 100 will now be described with reference to FIGS. 5*a* to 5*i*, where like-numbered elements refer to the same features illustrated in the figures. In accordance with an example embodiment of the invention, a fluidically driven downhole pump 500 is a combination fluidically-driven power turbine and pump. The power turbine rotates the pump at sufficient speed to generate a fluid pumping action. The turbine and pump are adjacent to each other and mounted as a common assembly. The power turbine is powered by a working fluid (not shown) descending from the surface 120 as previously described.

A concentric tubing string provides a circulation loop for the working fluid to return to the surface 120 as previously described. To build the concentric tubing string, the fluidically driven pump 500 is installed on a lower end of an outer tubing string 506 and lowered into a well 508, as with conventional oil field casing and tubing. The outer tubing string 506 with the fluidically driven pump 500 connected to the lower end of the outer tubing string 506 is suspended at the drilling rig floor using conventional casing slips. After reaching a selected depth, a false rotary is installed at the drilling rig floor. This allows the weight of subsequent smaller, inside tubing strings 512 and 514 to be transferred to the rig floor during running of the inside tubing strings 512 and 514. The false rotary supports a smaller set of slips and acts to support the inside tubing strings 512 and 514 as they are run into the larger outside tubing string 506.

Modified pipe hangers 522 are installed at the top of the outer tubing string 506 to allow suspension of the inside tubing string 512 in the outer tubing string 506. This same type of arrangement is used to run and suspend all subsequent tubing strings as the pipe size decreases. For example, the tubing string 512 has pipe hangers 523 mounted on an inner surface of tubing string 512 from which a tubing string 514 is suspended.

A set of seal receptacles are installed at the top of the fluidically driven pump 500, and the inside tubing strings 512 and 514 each have a seal assembly mounted at the lower end of each of these tubing strings as previously described. Each seal assembly on each tubing string is slipped into a respective seal receptacle at the top of the fluidically driven pump 500. This provides a pressure tight isolation of each of the inside tubing strings 512 and 514. The seal assemblies allow movement of each seal within the seal's respective receptacle to compensate for pipe movement due to wellbore temperature changes. The inside tubing strings 512 to 514 are run in sequence from the largest to the smallest. Each inside tubing string is run 512 or 514, is stabbed into the seal receptacle at the bottom of the tubing string 512 or 514, and suspended by a hanger, such as the hanger 522, at the top of the next larger tubing string.

The well completion system 100 allows intermediate equipment to be installed in a tubing string with concentric tubing strings and allows pressure isolation between the concentric tubing strings, if desired. The same system for running, sealing, and hanging can be used at multiple depths in the well.

An optional tail pipe 532 is installed below the fluidically driven pump 500 to allow the installation of many different types of devices. Some of the possible devices include screens for filtration of borehole fluid, slotted pipe to help guide the assembly into the hole and prevent the intrusion of wellbore debris and seal assemblies to isolate fluid flow from lower in the wellbore, mounting of packer assemblies to allow wellbore zonal isolation, centering devices, vibration damping devices, and the like.

An order of installation of the well completion system components, according to an embodiment of the invention, will now be presented with reference to FIGS. 5*a* to 5*i*.

Figure 5A:
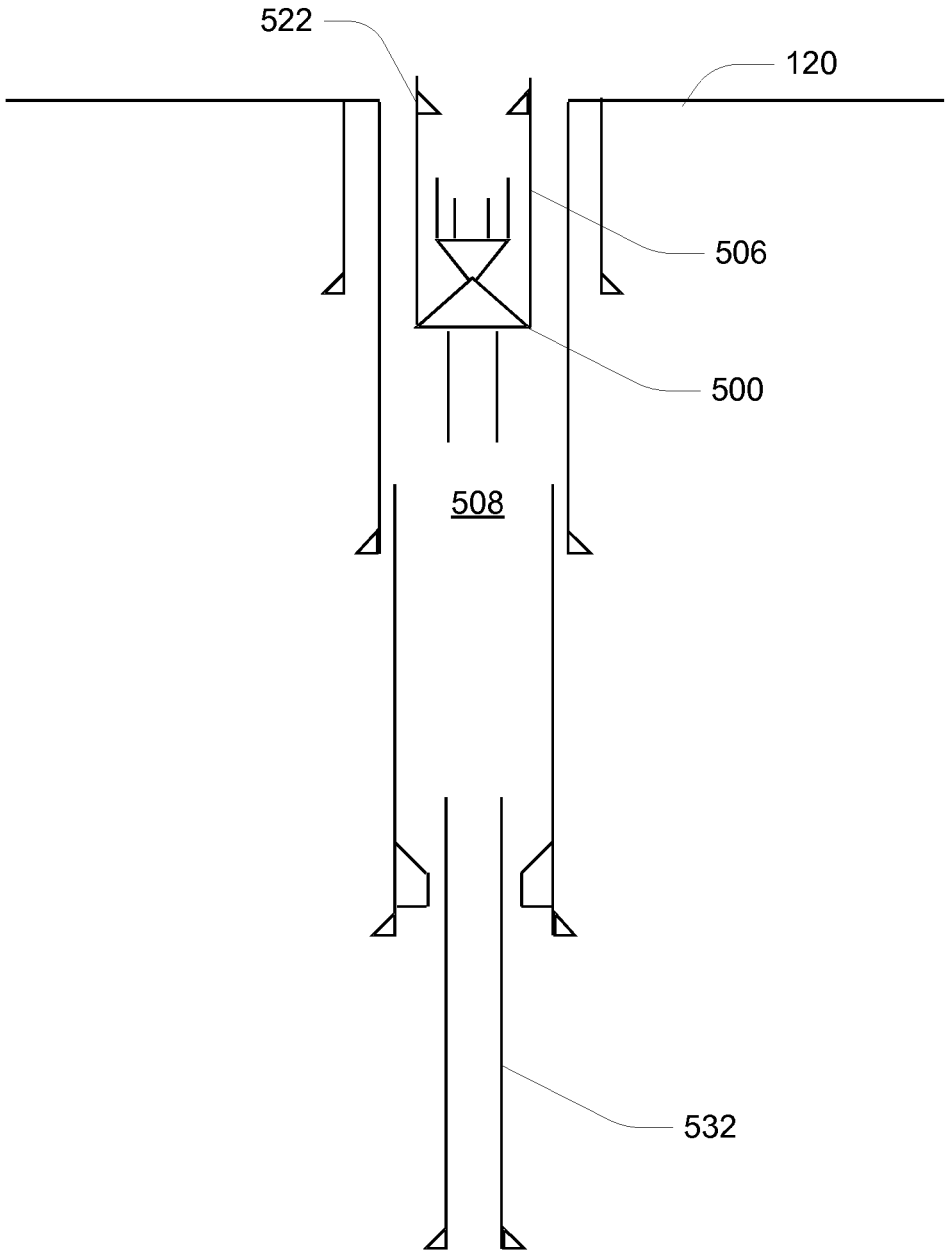
FIGS. 5*a* to 5*i* are longitudinal schematic drawings of an assembly sequence for a well completion system in accordance with an example embodiment of the invention.
Figure 5B:
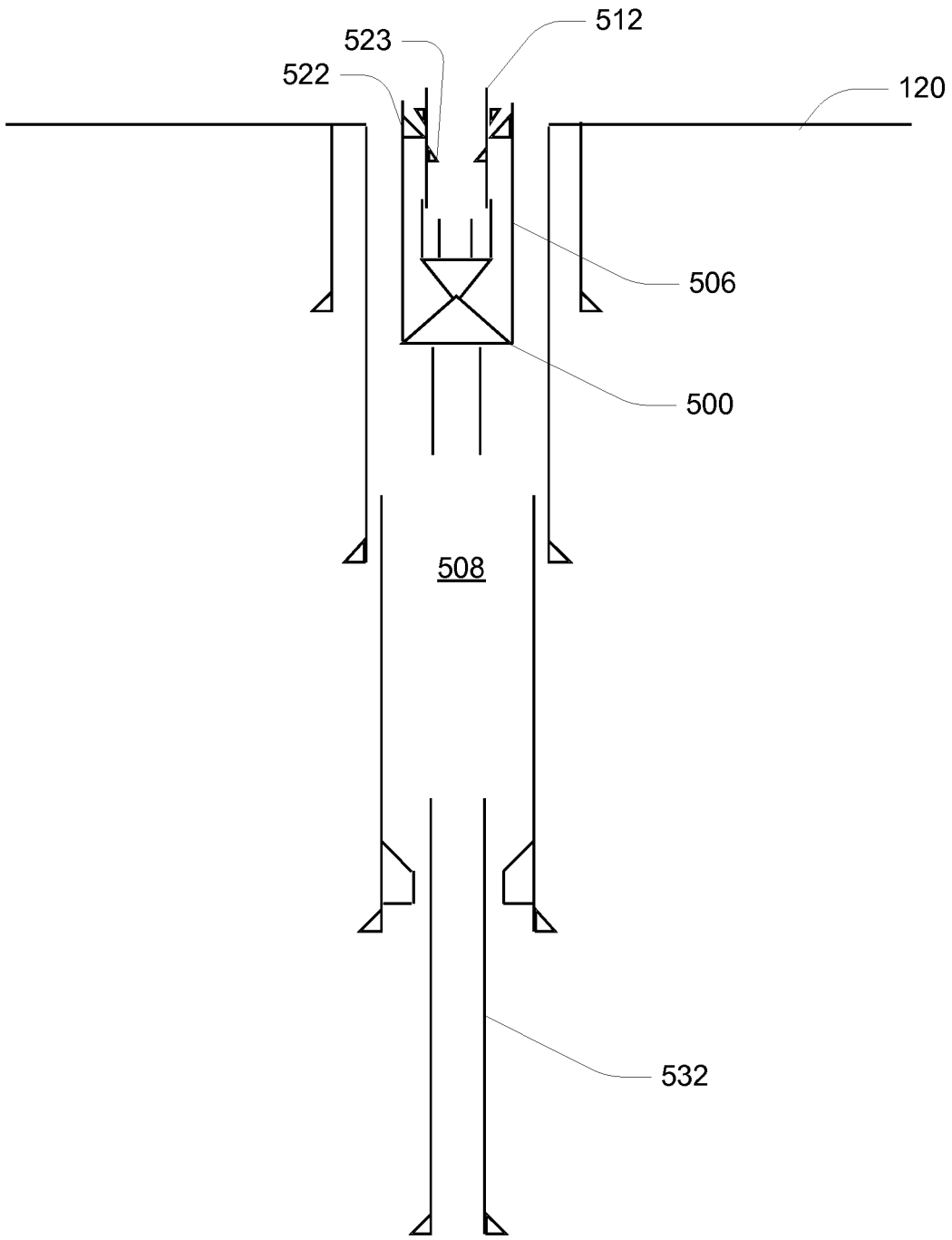
Figure 5C:
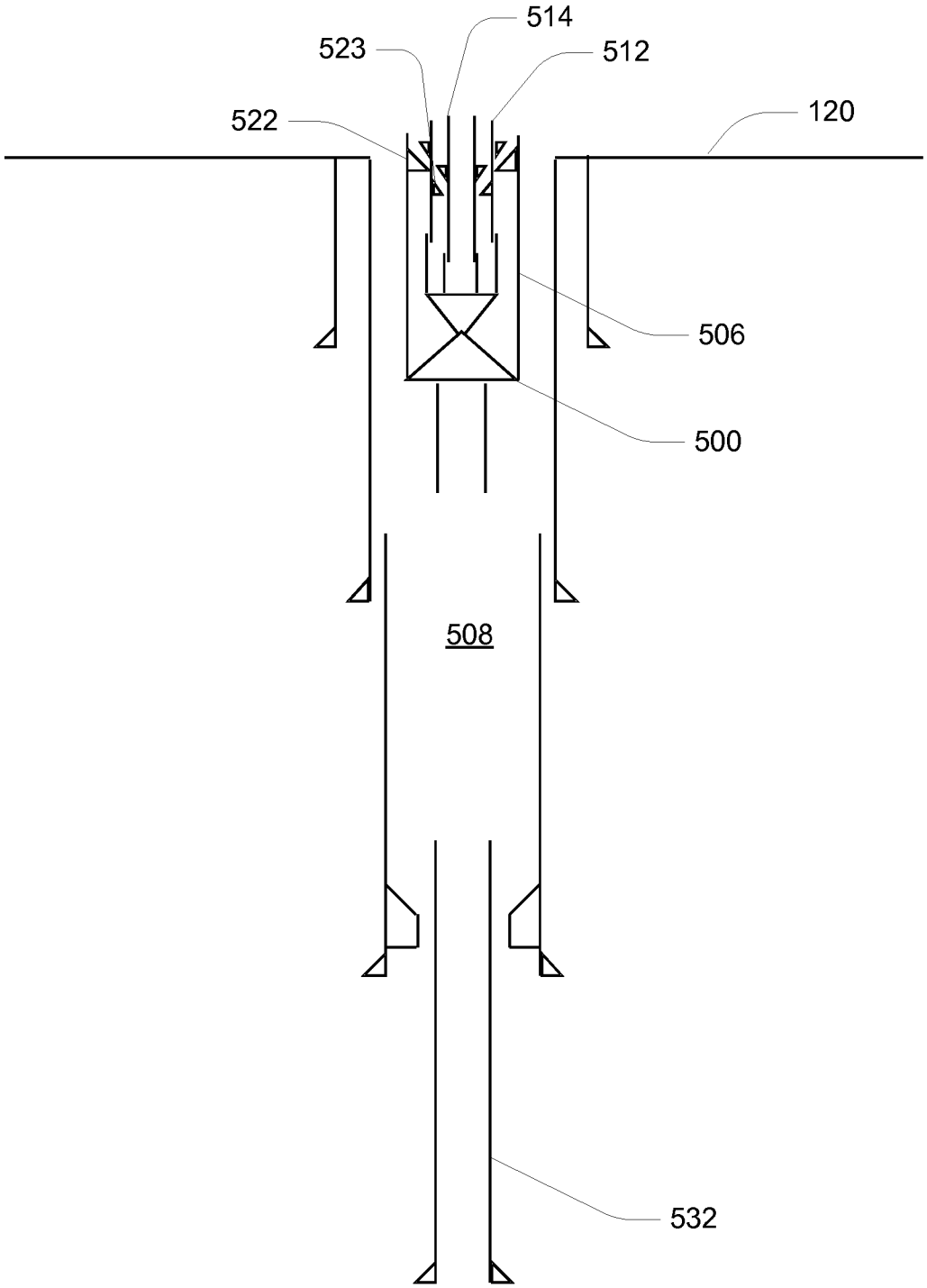

As depicted in FIG. 5*a*, the fluidically driven pump 500 is lowered into the well 508. The fluidically driven pump 500 is connected to a lower end of the outer tubing string 506. In FIG. 5*b*, the inner tubing string 512 is inserted into the outer tubing string 506. The lower end of the inner tubing string 512 has a sealing assembly that is inserted into a sealing receptacle of the fluidically driven pump 500. In FIG. 5*c*, inner tubing string 514 is inserted into inner tubing string 512 and is sealably connected to fluidically driven pump 500 by a respective sealing assembly and sealing receptacle.

Figure 5D:
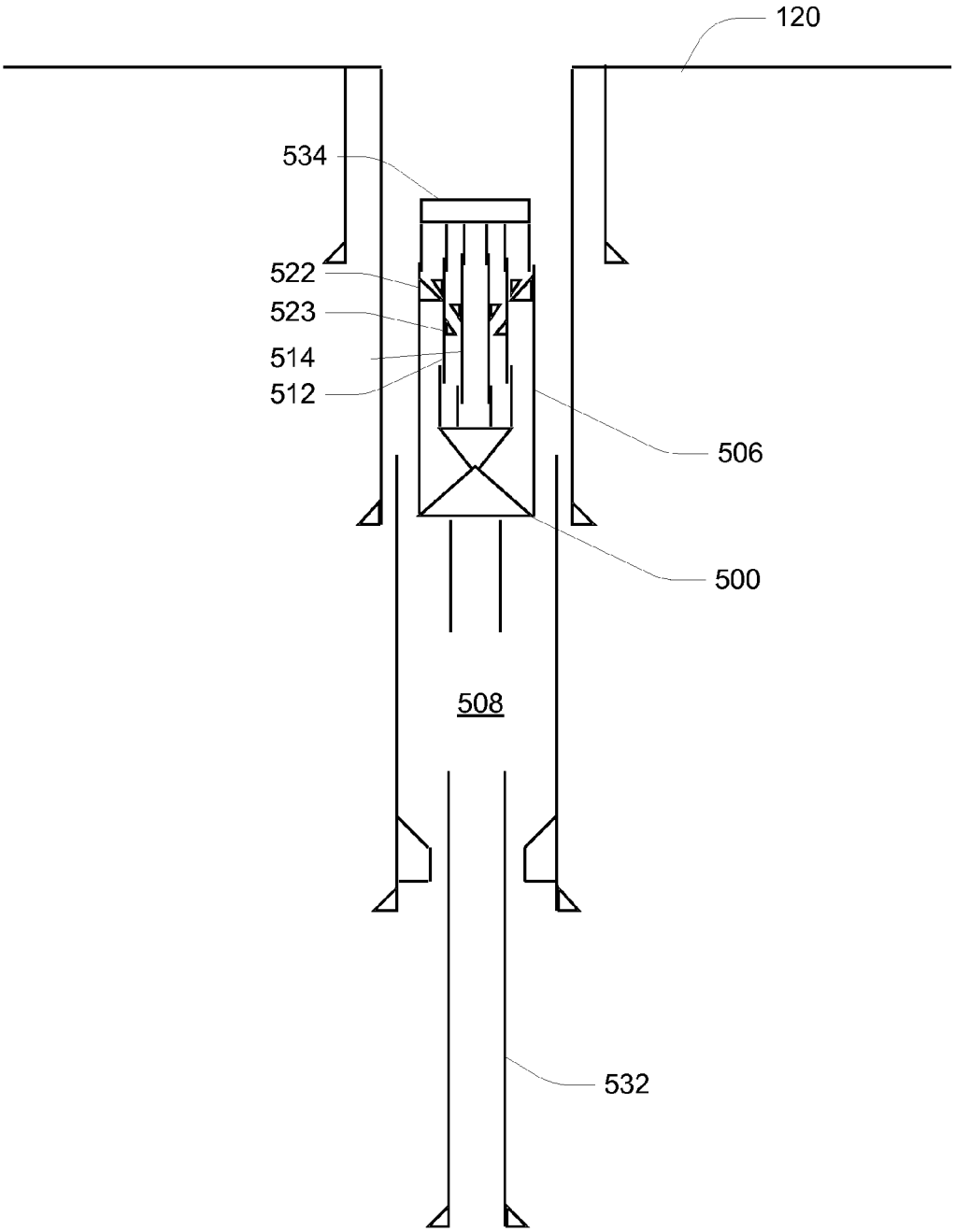
Figure 5E:
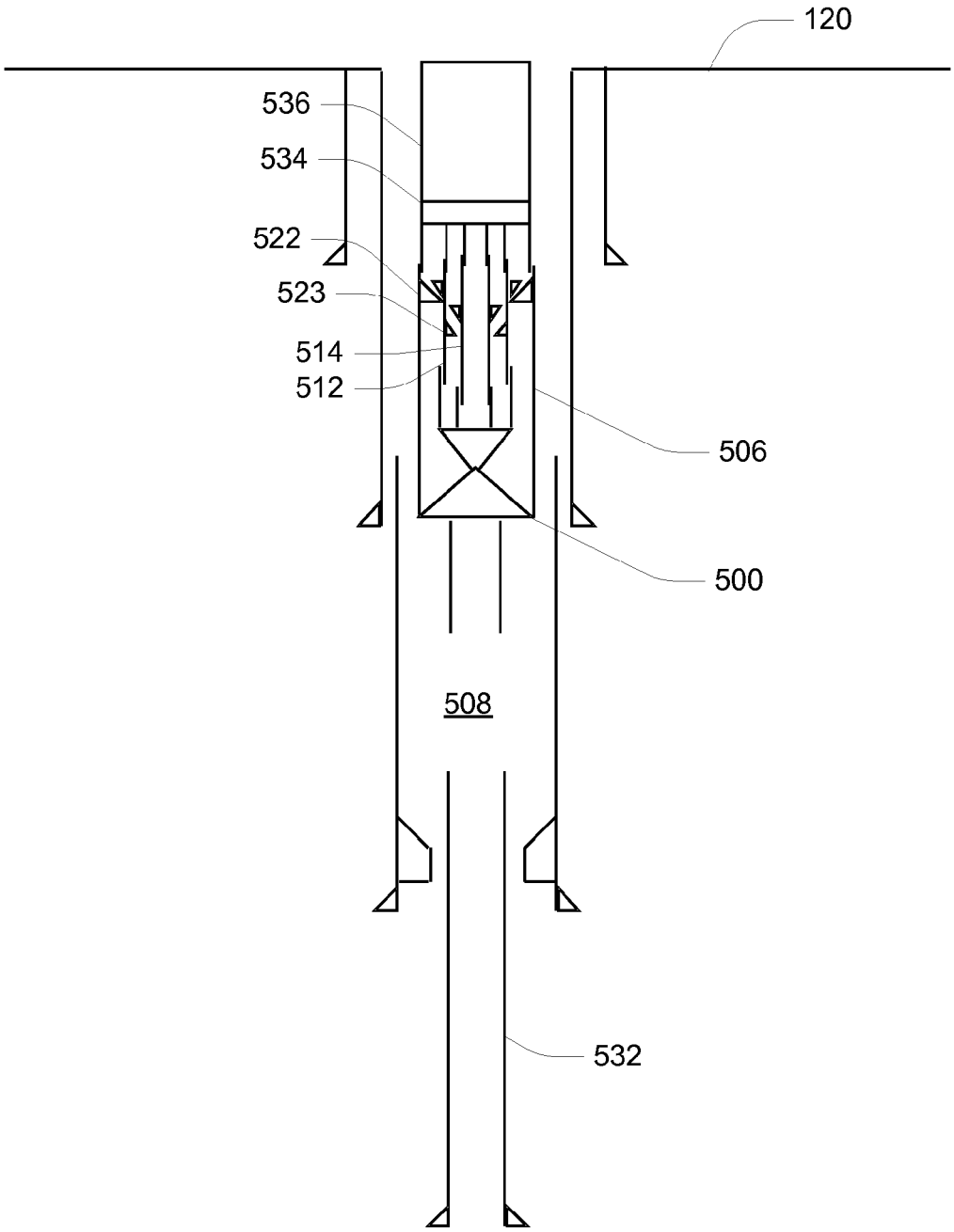
Figure 5F:
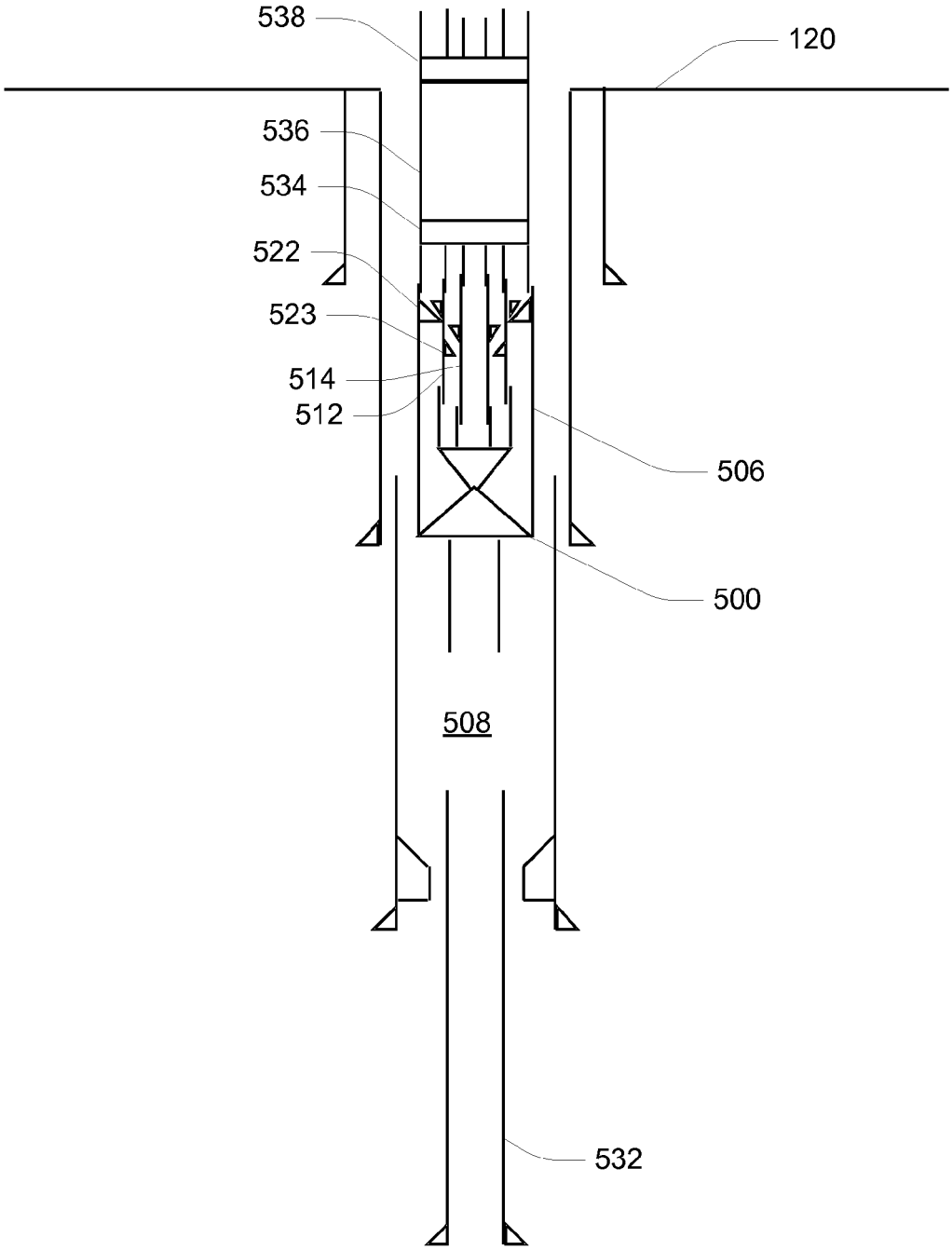

In FIG. 5*d*, a lower annular flow crossover 534 is attached to an upper end of the concentric tubing string created from tubing strings 506, 512 and 514. In FIG. 5*e*, one or more heat exchangers 536 are installed onto the lower annular flow crossover 534. In FIG. 5*f*, an upper annular flow crossover 538 is installed on an upper end of heat exchanger 536.

Figure 5G:
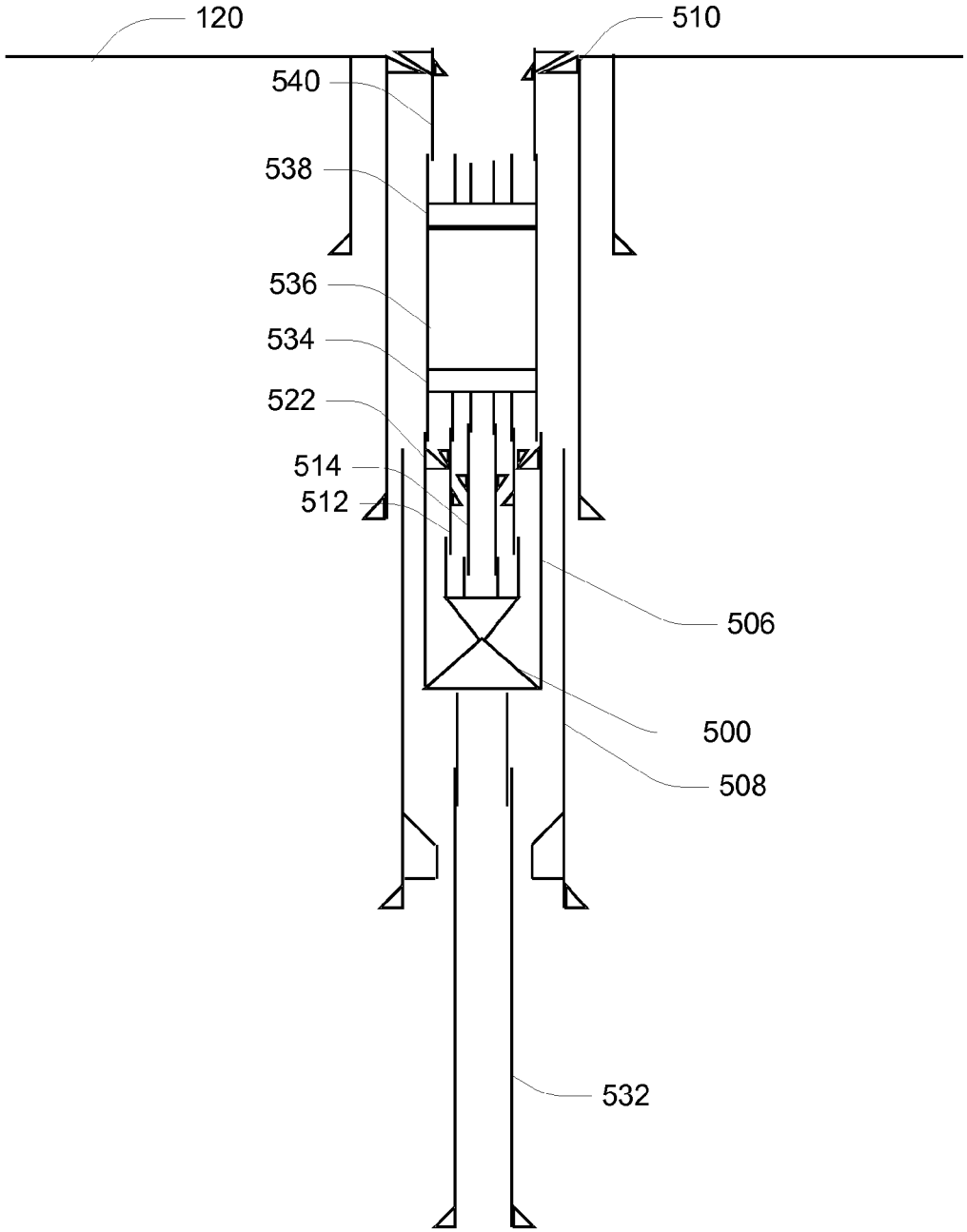
Figure 5H:
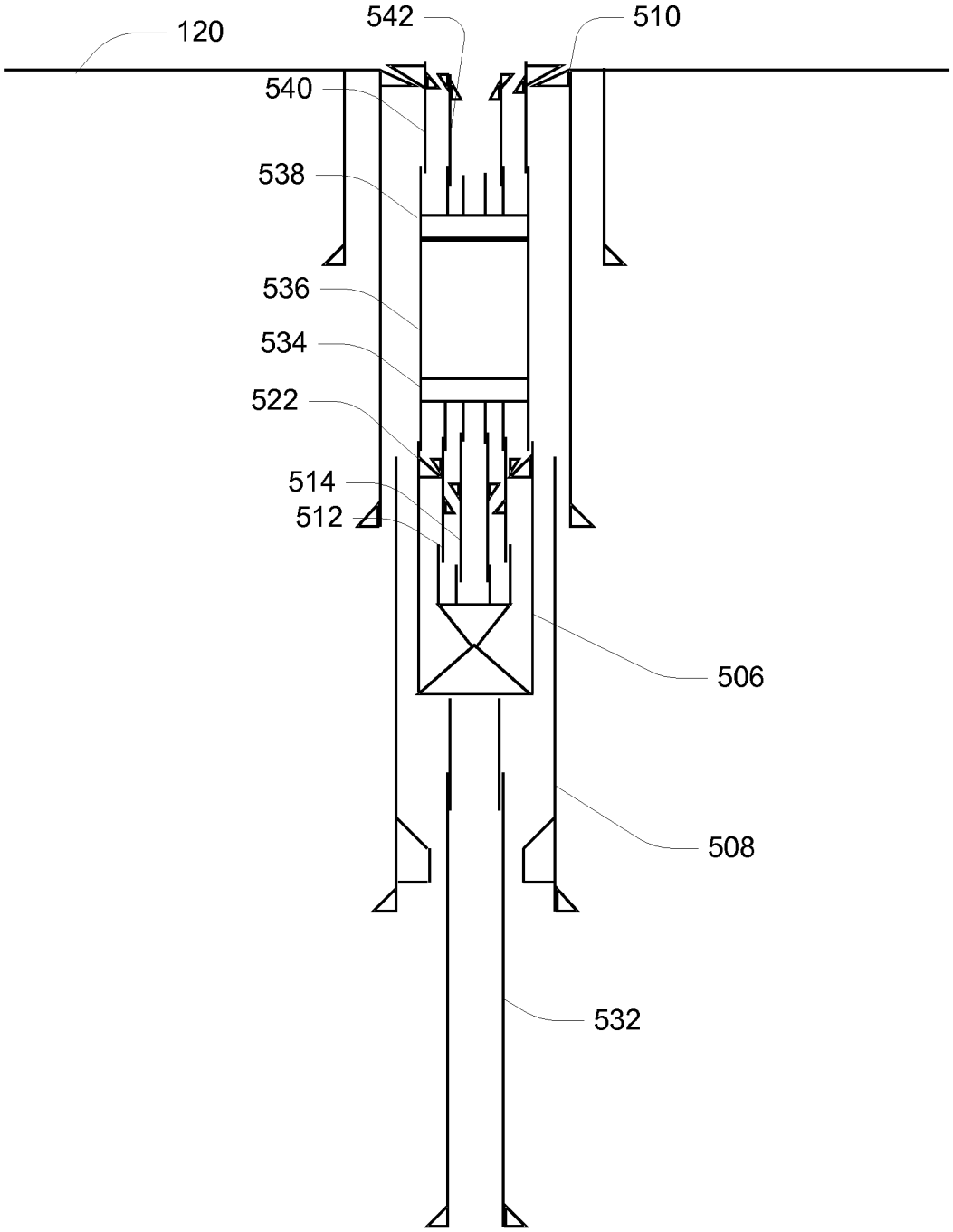
Figure 5I:
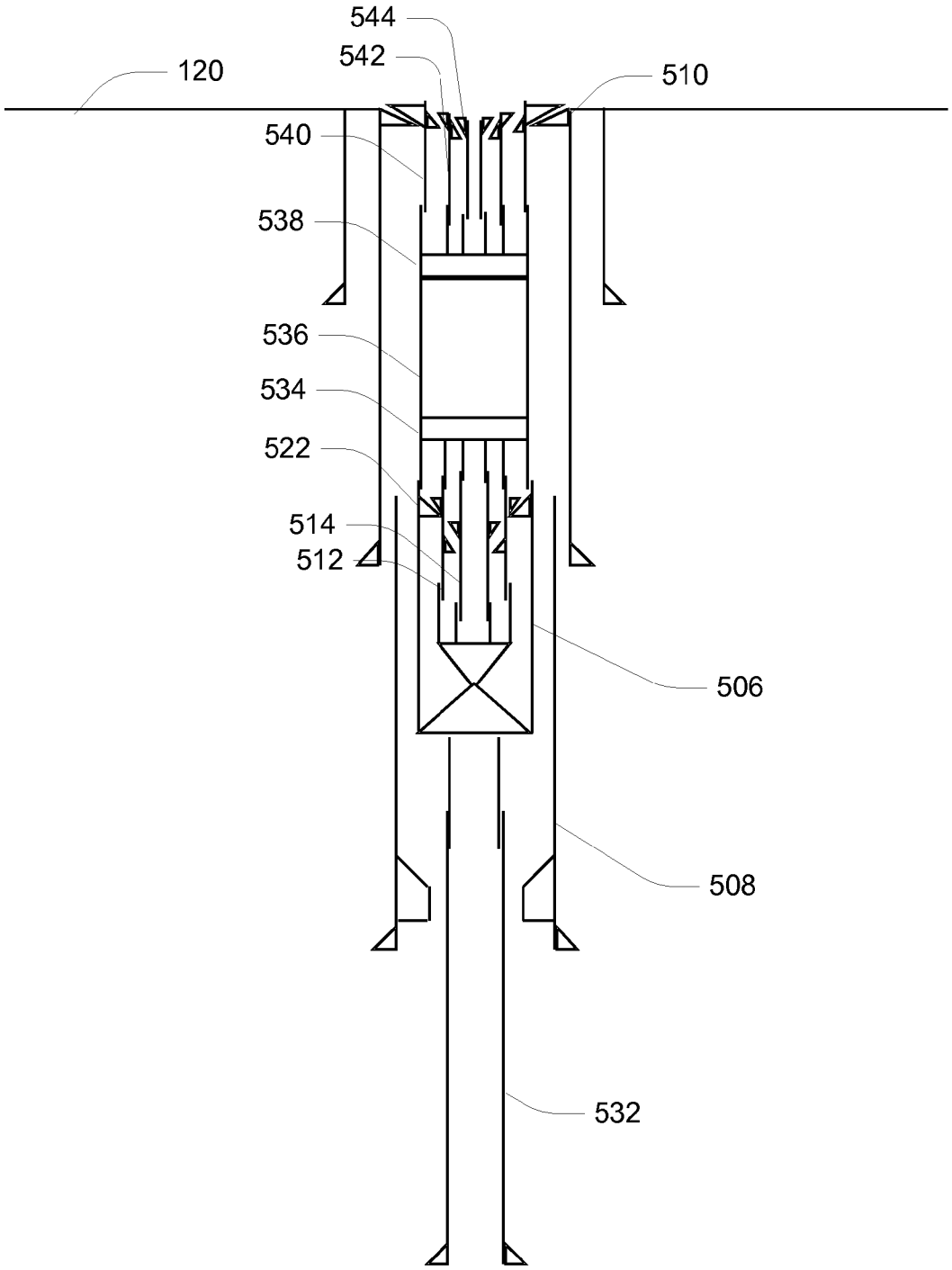

As depicted in FIG. 5*g*, an outer tubing string 540 of an upper concentric tubing string is installed. In FIG. 5*h*, an inner tubing string 542 of the upper concentric tubing string is installed. In FIG. 5*i*, another inner tubing string 544 is installed, thus completing the well completion system.

Having presented an embodiment of a well completion system having concentric annular flow channels utilizing subsurface crossovers to route fluid flow through a heat exchanger and subsurface pump, an embodiment of a well completion system having concentric annular flow channels that does not utilize crossovers will now be presented. This embodiment of a well completion system minimizes the use of polished bore receptacles, exchanger crossovers, and in-well hanger assemblies. The entire casing assembly, including a subsurface heat exchanger, is threaded together and hangs from a wellhead.

Figure 6A:
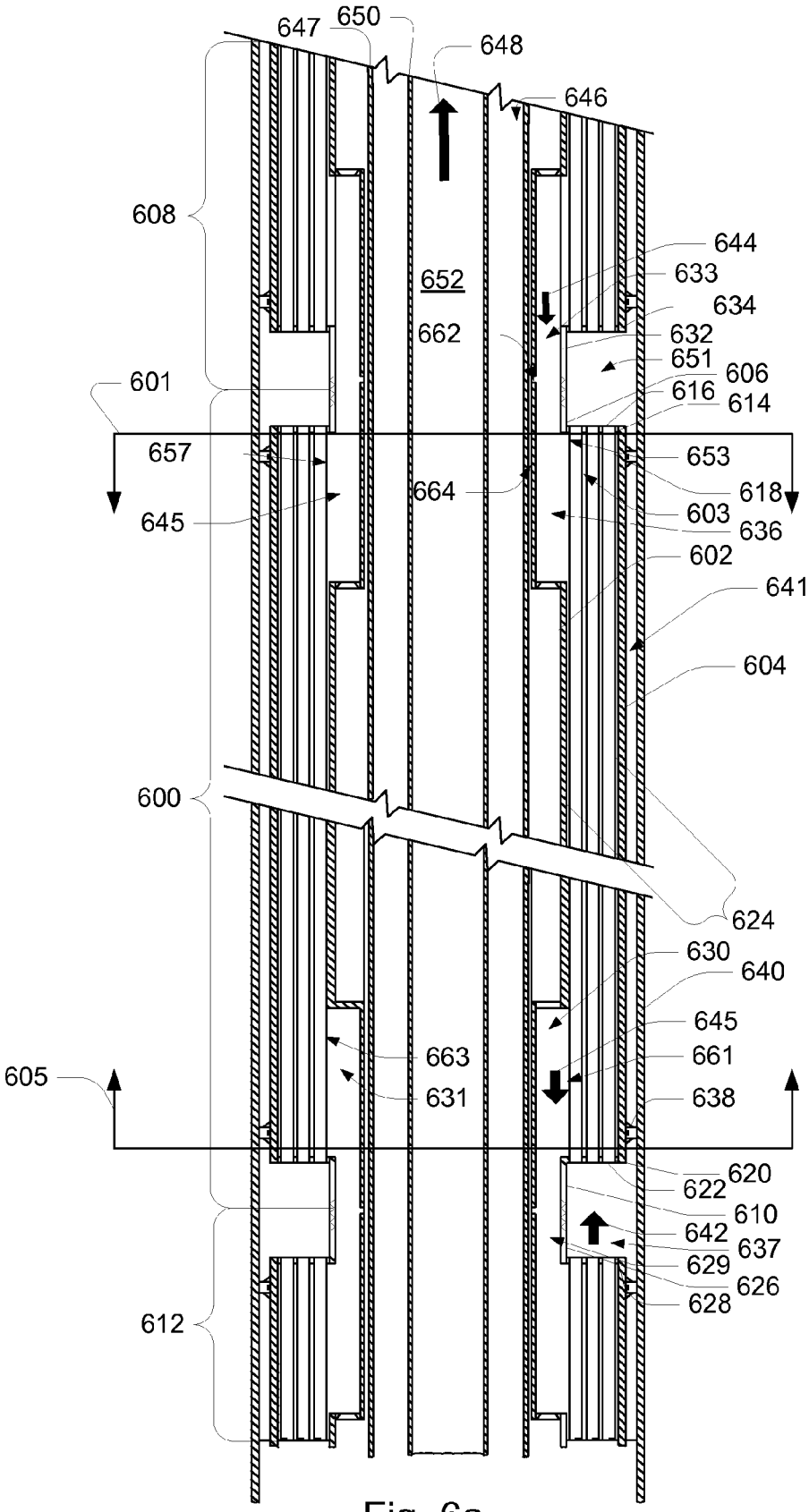
FIG. 6*a* is a longitudinal cross-sectional schematic drawing of sections of a subsurface heat exchanger in accordance with an example embodiment of the invention.
Figure 6B:
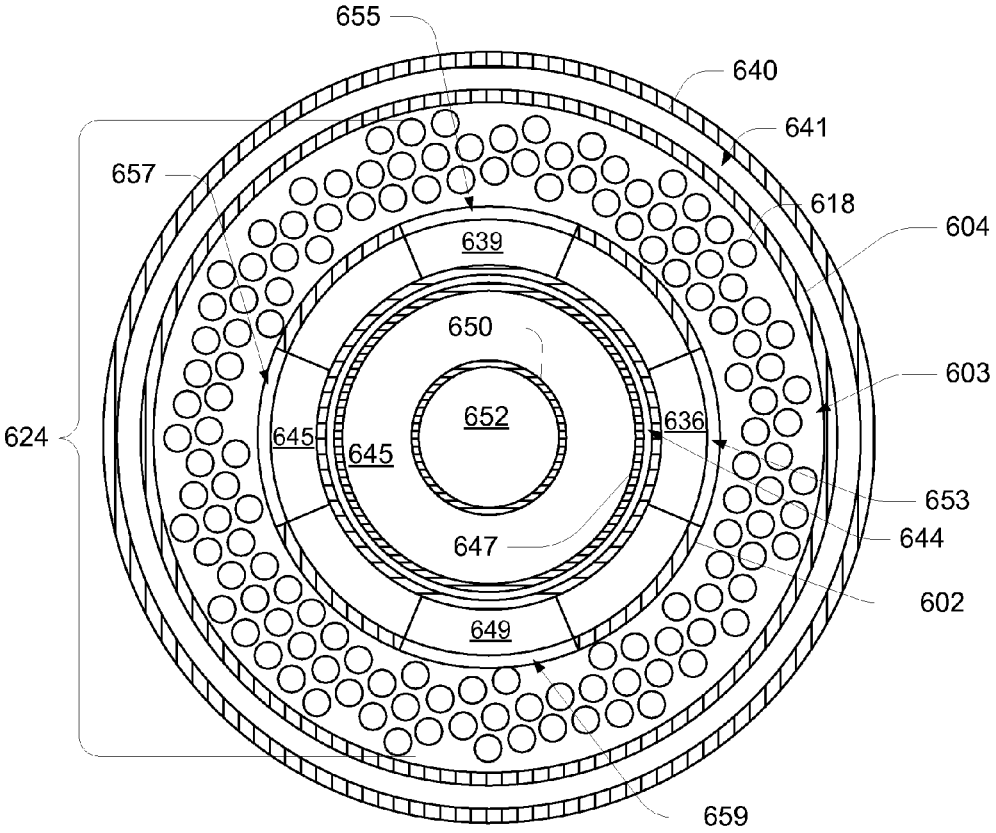
FIG. 6*b* is a lateral cross-sectional schematic drawing of a downward view of a section of a subsurface heat exchanger in accordance with an example embodiment of the invention.
Figure 6C:
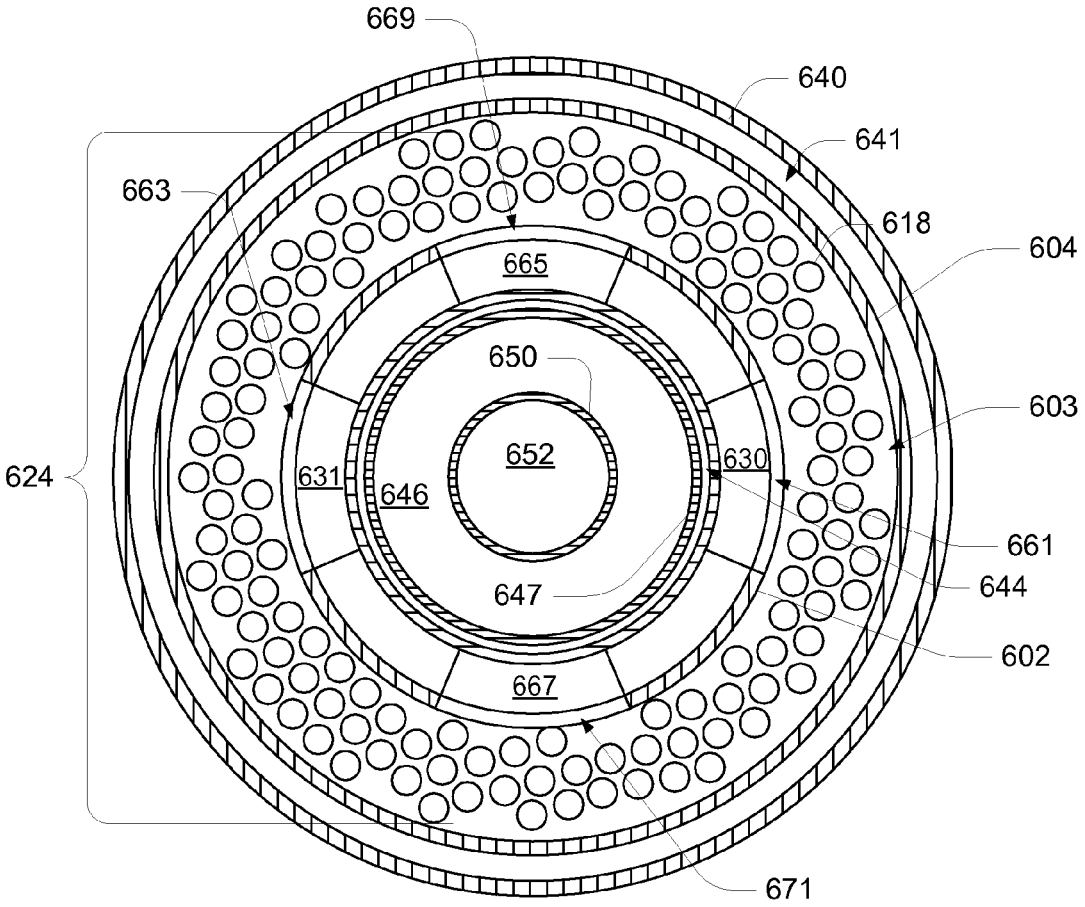
FIG. 6*c* is a lateral cross-sectional schematic drawing of an upward view of a section of a subsurface heat exchanger in accordance with an example embodiment of the invention.

Referring now to FIGS. 6*a*, 6*b*, and 6*c*, where like-numbered elements refer to the same features illustrated in the figures, FIG. 6*a* is a longitudinal cross-sectional schematic drawing of sections of a subsurface heat exchanger in accordance with an example embodiment of the invention, FIG. 6*b* is a lateral cross-sectional schematic drawing of a downward view of a section of a subsurface heat exchanger in accordance with an example embodiment of the invention, and FIG. 6*c* is a lateral cross-sectional schematic drawing of an upward view of a section of a subsurface heat exchanger in accordance with an example embodiment of the invention. A cutline 601 in FIG. 6*a* indicates the location of the lateral cross-section of FIG. 6*b* and a cutline 605 in FIG. 6*a* indicates the location of the lateral cross-section of FIG. 6*c*. A subsurface heat exchanger section 600 has an inner shell 602 and an outer shell 604 defining an annular chamber 603 therebetween. The inner shell 602 has an upper threaded portion 606 that threadably connects the subsurface heat exchanger section 600 to another (upper) subsurface heat exchanger section 608 (of which only a portion is shown) located above the subsurface heat exchanger section 600 in a wellbore, thus forming a threaded casing interconnection joint. The inner shell 602 also has a lower threaded portion 610 that threadably connects the subsurface heat exchanger section 600 to another subsurface heat exchanger section 612 (of which only a portion is shown) located below the subsurface heat exchanger section 600 in the wellbore, thus forming another threaded casing interconnection joint.

An upper annular ring 614 extends outwardly from an outer surface of the upper threaded portion 606 of the inner shell 602 to an inner surface of the outer shell 604. The upper annular ring 614 has one or more openings 616 to which one or more heat exchanger tubes 618 are sealably connected at a respective first end of each of the heat exchanger tubes 618. A lower annular ring 620 extends outwardly from an outer surface of the lower threaded portion 610 of the inner shell 602. The lower annular ring 620 has one or more openings 622 to which the one or more heat exchanger tubes 618 are sealably connected at a respective second end of each of the heat exchanger tubes 618. As such, the upper annular ring 614 and the lower annular ring 620 form two face plates with the heat exchanger tubes 618 extending therebetween thus defining a heat exchanger tubing bundle 624 passing through the annular chamber 603 defined between the inner shell 602 and the outer shell 604.

As the lower subsurface heat exchanger section 612 is constructed in a similar manner as the subsurface heat exchanger section 600, the lower subsurface heat exchanger section 612 has an upper threaded portion 626 and an upper annular ring 628 as well. When the subsurface heat exchanger section 600 and the lower subsurface heat exchanger section 612 are connected, the lower threaded portion 610 of the subsurface heat exchanger section 600 and the upper threaded portion 626 of the lower subsurface heat exchanger section 612 define a flow channel 629 in communication with one or more outlet boxes, such as outlet boxes 630, 631, 665, and 667, of the annular chamber 603 of the subsurface heat exchanger section 600. In a similar manner, the upper subsurface heat exchanger section 608 has a lower threaded portion 632 as well. When the subsurface heat exchanger section 600 and the upper subsurface heat exchanger section 608 are connected, the upper threaded portion 606 of the subsurface heat exchanger section 600 and the lower threaded portion 632 of the upper subsurface heat exchanger section 608 define a flow channel 633 in communication with one or more inlet boxes, such as inlet boxes 636, 639, 645, and 649, of the annular chamber 603 of the subsurface heat exchanger section 600.

The inlet boxes, such as inlet boxes 636, 639, 645, and 649 are each located at a respective longitudinal slot, such as longitudinal slots 653, 655, 657, and 659, extending through and partially along the length of the inner shell 602 of the subsurface heat exchanger section 600. In addition, each outlet box, such as the outlet boxes 630, 631, 665, and 667, are also located at a respective longitudinal slot, such as longitudinal slots 661, 663, 669, and 671, extending through and partially along the length of the inner shell 602 of the subsurface heat exchanger section 600. As the inner shell 602 casing is designed to carry the load of the subsurface heat exchanger section 600 throughout the depth of the well, the longitudinal slots, such as the longitudinal slots 653, 655, 657, 659, 661, 663, 669, and 671, are designed so as to minimize the effect on the load carrying capacity of the inner shell 602 casing.

One or more annular seals 638 are located on an outer surface of the outer shell 604 and form a complete or partial seal between the outer surface of the outer shell 604 and an inner surface of a wellbore casing 640. When a first fluid, such as heated fluid from a production zone of a geothermal well, flows upwards into a tubing inlet chamber 637, as indicated by flow arrow 642, the one or more annular seals 638 divert the fluid, either completely or partially, into an interior portion of the heat exchanger tubing bundle 624. The fluid flows through the interior portion of the heat exchanger tubing bundle 624 and exits into a tubing outlet chamber 651. The one or more annular seals 638 create sufficient flow resistance to route up-flowing fluid into the heat exchanger tubing bundle 624 as the path of least resistance and allow the up flowing fluid to freely flow between subsequently stacked heat exchanger tubing bundles while minimizing up-flowing fluid that will bypass the heat exchanger tubing bundle 624. As the one or more annular seals 638 may form a partial seal between the outer surface of the outer shell 604 and the inner surface of the wellbore casing 640, an annular space 641 between the outer shell 604 and the inner surface of the wellbore casing 640 may be filled with a fluid. As such, there may be some minimal flow of fluid in the annular space 641.

A second fluid, such as a working fluid for a subsurface turbomachine, flows downwardly in the flow channel 633, as indicated by flow arrow 644, flows into the inlet boxes, such as inlet boxes 636, 639, 645, and 649, of the annular chamber 603 of the subsurface heat exchanger section 600, then flows through the annular chamber 603, and around outer surfaces of the heat exchanger tubes 618. The working fluid then flows out of the outlet boxes, such as the outlet boxes 630, 631, 665, and 667 of the annular chamber 603 of the subsurface heat exchanger section 600 through the flow channel 629, as indicated by flow arrow 645.

As described herein, the first fluid, such as heated fluid from the production zone of a geothermal well, flows upwardly and contains heat that is transferred to the second fluid, such as working fluid for a subsurface turbomachine, that flows downwardly. It is to be understood that the flow paths of the fluids may be exchanged. For example, the second or working fluid can flow through the interior portion of the tubing bundle 624 of the subsurface heat exchanger section 600 while the first or heated fluid can flow through the annular chamber 603 of the subsurface heat exchanger section 600 depending only upon how the two fluids are routed to the subsurface heat exchanger section 600.

As mentioned earlier, the upper annular ring 614 and the lower annular ring 620 form two face plates with the heat exchanger tubes 618 extending therebetween thus defining a heat exchanger tubing bundle 624 passing through the annular chamber 603 defined between the inner shell 602 and the outer shell 604.

The inner shell 602 also defines an open inside diameter 646 that extends through the length of the subsurface heat exchanger section 600. An internal casing string 647 extends through the open inside diameter 646 and provides a conduit for subsurface equipment to be installed and runs to the top of the well. In addition, an additional casing string 650 can pass through an interior of the internal casing string 647, thus defining another flow channel 652 used for return of the working fluid, as indicated by flow arrow 648. Used in this way, the internal casing string 647 allows for a thermal barrier between an up-flowing working fluid flowing through the flow channel 652 and a down-flowing working fluid in the flow channel 643.

The lower threaded portion 632 of the upper subsurface heat exchanger section 608 and the threaded portion 606 of the subsurface heat exchanger section 600 are machined to a tolerance that leaves a small gap 662 between the subsurface heat exchanger sections 608 and 600 when the threaded portions 606 and 632 are fully engaged. As such, an annular space 664 between the interior casing 647 and the inner shell 602 of the subsurface heat exchanger section 600 can be filled with working fluid and, consequently, there may be some minimal flow of working fluid in the annular space 664. Therefore, the outside diameters of the outlet box 630 and the inlet box 636 of the annular chamber 603 are fabricated so as to minimize the width of the annular space 664 between the outside diameters of the outlet box 630 and the inlet box 636 and the outside diameter of the internal casing string 647, which serves to guide the working fluid into the inlet box 636 of the annular chamber 603 as the path of least resistance.

The subsurface heat exchanger can be sized according to the amount of produced heated fluid and the size of the wellbore. In an embodiment of the subsurface heat exchanger in accordance with an aspect of the invention, the well bore casing 640 is 26 inches in diameter, the outer shell 604 of the subsurface heat exchanger section 600 is 24 inches in diameter, the lower threaded portion 610 of the inner shell 602 of the subsurface heat exchanger section 600 is 16 inches in diameter, and the internal casing string 647 is 10¾ inches in diameter. In addition, the heat exchanger tubes are ⅝ inch in diameter.

Figure 7A:
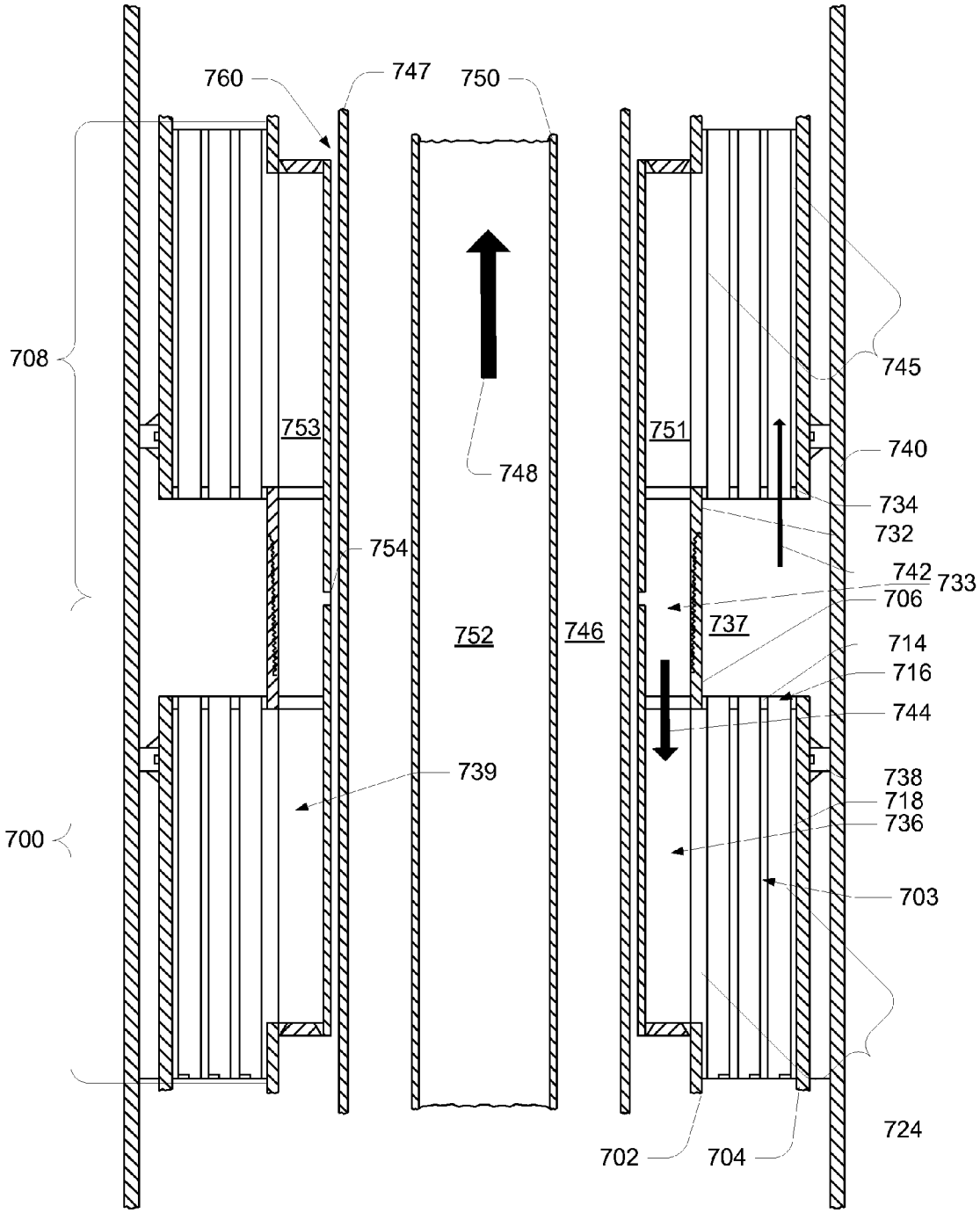
FIG. 7*a* is a longitudinal cross-sectional schematic drawing of an interconnection between sections of a subsurface heat exchanger in accordance with an example embodiment of the invention.

FIG. 7*a* is a longitudinal cross-sectional schematic drawing of an interconnection between sections of a subsurface heat exchanger in accordance with an example embodiment of the invention. A subsurface heat exchanger section 700 (of which only a portion is shown) has an inner shell 702 and an outer shell 704. The inner shell 702 has an upper threaded portion 706 that threadably connects the subsurface heat exchanger section 700 to another (upper) subsurface heat exchanger section 708 (of which only a portion is shown) located above the subsurface heat exchanger section 700 in a wellbore, thus forming a threaded casing interconnection joint. The inner shell 702 also has a lower threaded portion (not shown) that threadably connects the subsurface heat exchanger section 700 to another subsurface heat exchanger section (not shown) located below the subsurface heat exchanger section 700 in the wellbore, thus forming another threaded casing interconnection joint.

An upper annular ring 714 extends outwardly from an outer surface of the upper threaded portion 706 of the inner shell 702 to an inner surface of the outer shell 704. The upper annular ring 714 has one or more openings 716 to which one or more heat exchanger tubes 718 are sealably connected at a respective first end of each of the heat exchanger tubes 718. A lower annular ring (not shown) extends outwardly from an outer surface of the lower threaded portion (not shown) of the inner shell 702. The lower annular ring (not shown) has one or more openings to which the one or more heat exchanger tubes 718 are sealably connected at a respective second end of each of the heat exchanger tubes 718. As such, the upper annular ring 714 and the lower annular ring (not shown) form two face plates with the heat exchanger tubes 718 extending therebetween thus defining a heat exchanger tubing bundle 724 passing through an annular chamber 703 defined between the inner shell 702 and the outer shell 704.

The upper subsurface heat exchanger section 708 has a lower threaded portion 732 and a lower annular ring 734 as well. When the subsurface heat exchanger section 700 and the upper subsurface heat exchanger section 708 are connected, the upper threaded portion 706 of the subsurface heat exchanger section 700 and the lower threaded portion 732 of the upper subsurface heat exchanger section 708 define a flow channel 733 in communication with one or more outlet boxes, such as outlet boxes 751 and 753 of the upper subsurface heat exchanger section 708, and one or more inlet boxes, such as inlet boxes 736 and 739, of the annular chamber 703 of the subsurface heat exchanger section 700.

One or more annular seals 738 are located on an outer surface of the outer shell 704 and form a complete or partial seal between the outer surface of the outer shell 704 and an inner surface of a wellbore casing 740. When a first fluid, such as heated fluid from a production zone of a geothermal well, flows upwards into a tubing inlet chamber 737, as indicated by flow arrow 742, the one or more annular seals 738 divert the fluid, either completely or partially, into an interior portion of a heat exchanger tubing bundle 745 of the connected upper subsurface heat exchanger section 708. The one or more annular seals, such as annular seal 738, create sufficient flow resistance to route the up-flowing fluid into the heat exchanger tubing bundle 745 as the path of least resistance, and allow the up-flowing fluid to freely flow between subsequently stacked heat exchanger tubing bundles while minimizing the up-flowing fluid that will bypass the heat exchanger tubing bundle 745.

A second fluid, such as a working fluid for a subsurface turbomachine, flows downwardly out of the outlet boxes, such as the outlet boxes 751 and 753, of the upper subsurface heat exchanger section 708, into the flow channel 733, as indicated by flow arrow 744, flows into the inlet boxes, such as the inlet boxes 736 and 739, of the annular chamber 703 of the subsurface heat exchanger section 700, then flows through the annular chamber 703, and around outer surfaces of the heat exchanger tubes 718.

As described above, the upper annular ring 714 and the lower annular ring (not shown) form two face plates with the heat exchanger tubes 718 extending therebetween thus defining the heat exchanger tubing bundle 724 passing through the annular chamber 703 defined between the inner shell 702 and the outer shell 704. The inner shell 702 also defines an open inside diameter 746 that extends through the length of the subsurface heat exchanger section 700. An internal casing string 747 extends through the open inside diameter 746. The internal casing string 747 may be used as an additional flow channel for return of a working fluid. In addition, an additional casing string 750 can pass through an interior of the internal casing string 747 thus defining another flow channel 752. Used in this way, the internal casing string 747 allows for a thermal barrier between an up-flowing working fluid flowing through flow channel 752, as indicated by flow arrow 748, and a down-flowing working fluid in the flow channel 733.

The threaded portions 706 and 732 are machined to a tolerance that leaves a small gap 754 between each subsurface heat exchanger section 700 and 708 when the threaded portions 706 and 732 are fully engaged. As such, an annular space 760 between the interior casing 747 and the inner shell 702 may be filled with working fluid and, consequently, there may be some minimal flow of working fluid in the annular space 760.

Figure 7B:
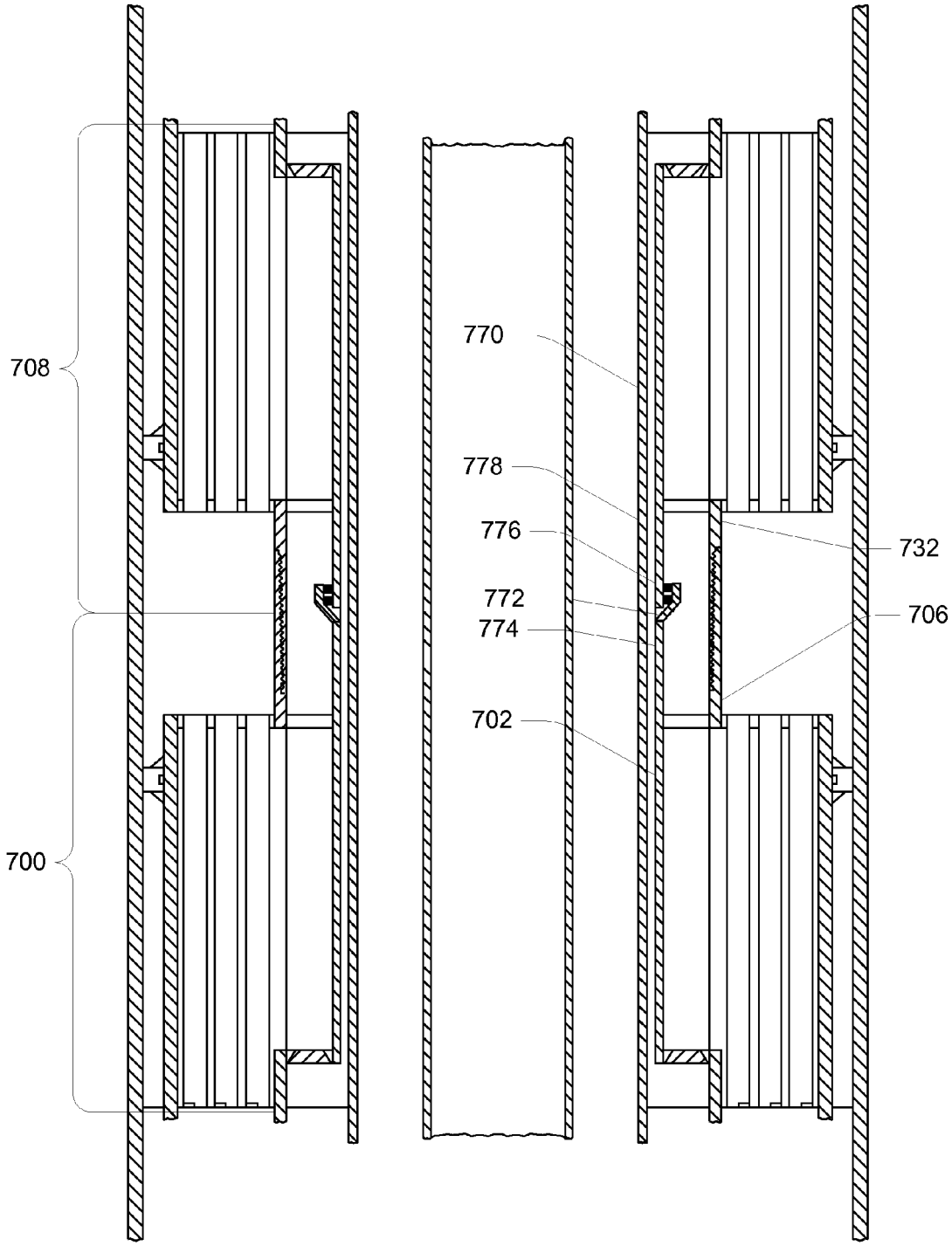
FIG. 7*b* is a longitudinal cross-sectional schematic drawing of an interconnection seal between sections of a subsurface heat exchanger in accordance with an example embodiment of the invention.

FIG. 7*b* is a longitudinal cross-sectional schematic drawing of an interconnection seal between sections of a subsurface heat exchanger in accordance with an example embodiment of the invention. As mentioned above, connection of the upper threaded portion 706 of the subsurface heat exchanger section 700 and the lower threaded portion 732 of the upper subsurface heat exchanger 708 may leave a small gap between each subsurface heat exchanger section 700 and 708 when the threaded portions 706 and 732 are fully engaged. To prevent leakage of the working fluid through this gap, a seal is located at the interconnection between the inner shell 702 of the subsurface heat exchanger section 700 and an inner shell 770 of the upper subsurface heat exchanger section 708. The seal includes a receptacle 772 located at an upper end 774 of the inner shell 702 of the subsurface heat exchanger section 700 and a sealing member 776 located on a lower end 778 of the inner shell 770 of the upper subsurface heat exchanger section 708. In operation, the sealing member 776 of the upper subsurface heat exchanger section 708 engages the receptacle 772, and locates into the receptacle 772, creating a seal between the inner shell 702 of the subsurface heat exchanger section 700 and the inner shell 770 of the upper subsurface heat exchanger section 708.

Figure 8:
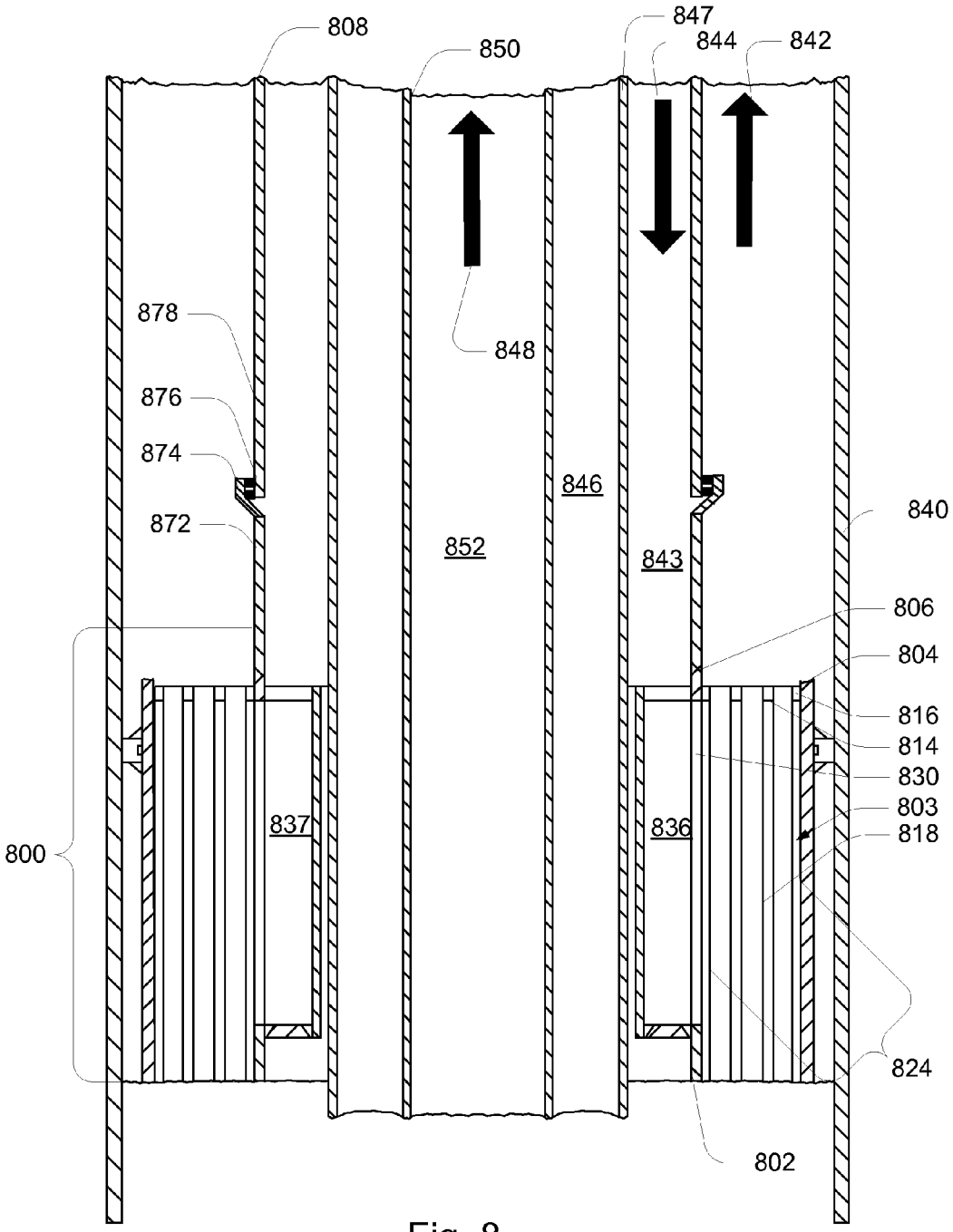
FIG. 8 is a longitudinal cross-sectional schematic drawing of a connection at an uppermost section of a subsurface heat exchanger in accordance with an example embodiment of the present invention.

FIG. 8 is a longitudinal cross-sectional schematic drawing of a connection at an uppermost section of a subsurface heat exchanger in accordance with an example embodiment of the present invention. An uppermost subsurface heat exchanger section 800 (of which only a portion is shown) has an inner shell 802 and an outer shell 804. The inner shell 802 has an upper end 872 that has a receptacle 874 of the subsurface heat exchanger section 800. The receptacle 874 mates with a sealing member 876 located on a lower end 878 of a casing string 808. In operation, the sealing member 876 of the casing string 808 engages the receptacle 874, and locates into the receptacle 874, creating a seal between the inner shell 802 of the subsurface heat exchanger section 800 and the casing string 808.

An upper annular ring 814 extends outwardly from an outer surface of the upper threaded portion 806 of the inner shell 802 to an inner surface of the outer shell 804. The upper annular ring 814 has one or more openings 816 to which one or more heat exchanger tubes 818 are sealably connected at a respective first end of each of the heat exchanger tubes 818. A lower annular ring (not shown) extends outwardly from an outer surface of a lower threaded portion (not shown) of the inner shell 802. The lower annular ring (not shown) has one or more openings to which the one or more heat exchanger tubes 818 are sealably connected at a respective second end of each of the heat exchanger tubes 818. As such, the upper annular ring 814 and the lower annular ring (not shown) form two face plates with the heat exchanger tubes 818 extending therebetween thus defining a heat exchanger tubing bundle 824 passing through an annular chamber 803 defined between the inner shell 802 and the outer shell 804.

A first fluid, such as heated fluid from a production zone of a geothermal well, flows upwards, as indicated by flow arrow 842, out of an interior portion of the heat exchanger tubing bundle 824 of the subsurface heat exchanger section 800. A second fluid, such as a working fluid for a subsurface turbomachine, flows downwardly in an annular flow channel 843 defined by the inner surface of the inner shell 802 and the outer surface of an internal casing string 847, as indicated by flow arrow 844, and flows through an inlet box, such as inlet boxes 836 and 837, into the annular chamber 803 and around outer surfaces of the heat exchanger tubes 818.

As described above, the upper annular ring 814 and the lower annular ring (not shown) form two face plates with the heat exchanger tubes 818 extending therebetween thus defining the heat exchanger tubing bundle 824 passing through the annular chamber 803 defined between the inner shell 802 and the outer shell 804. The inner shell 802 also defines an open inside diameter 846 that extends through the length of the subsurface heat exchanger section 800. The internal casing string 847 extends through the open inside diameter 846. A casing string 850 can pass through an interior of the internal casing string 847, thus defining a flow channel 852 through which the working fluid flows upwardly, as indicated by flow arrow 848. The internal casing string 847 allows for insertion and removal of subsurface turbomachinery as previously described.

In an embodiment of a connection at an uppermost section of a subsurface heat exchanger in accordance with an example embodiment of the present invention, the outer shell 804 includes a threaded portion (not shown) that engages with an additional casing string (not shown), forming a flow channel for upwardly flowing heated fluid coming out of the tubing bundle 824. In addition, the additional casing string (not shown) forms another flow channel between the exterior surface of the additional casing string and the interior surface of a wellbore casing 840 for upwardly flowing heated fluid that may have bypassed the tubing bundle 824.

In another embodiment of a connection at an uppermost section of a subsurface heat exchanger in accordance with an example embodiment of the present invention, the inner shell 802 is threadably attached to the casing string 808, and the outer shell 804 includes a receptacle (not shown) that engages with a sealing member of an additional casing string (not shown), forming a flow channel for upwardly flowing heated fluid coming out of the tubing bundle 824. In addition, the additional casing string (not shown) forms another flow channel between the exterior surface of the additional casing string and the interior surface of the wellbore casing 840 for upwardly flowing heated fluid that may have bypassed the tubing bundle 824.

In another embodiment of a connection at an uppermost section of a subsurface heat exchanger in accordance with an example embodiment of the present invention, the inner shell 802 is threadably attached to the casing string 808.

Figure 9:
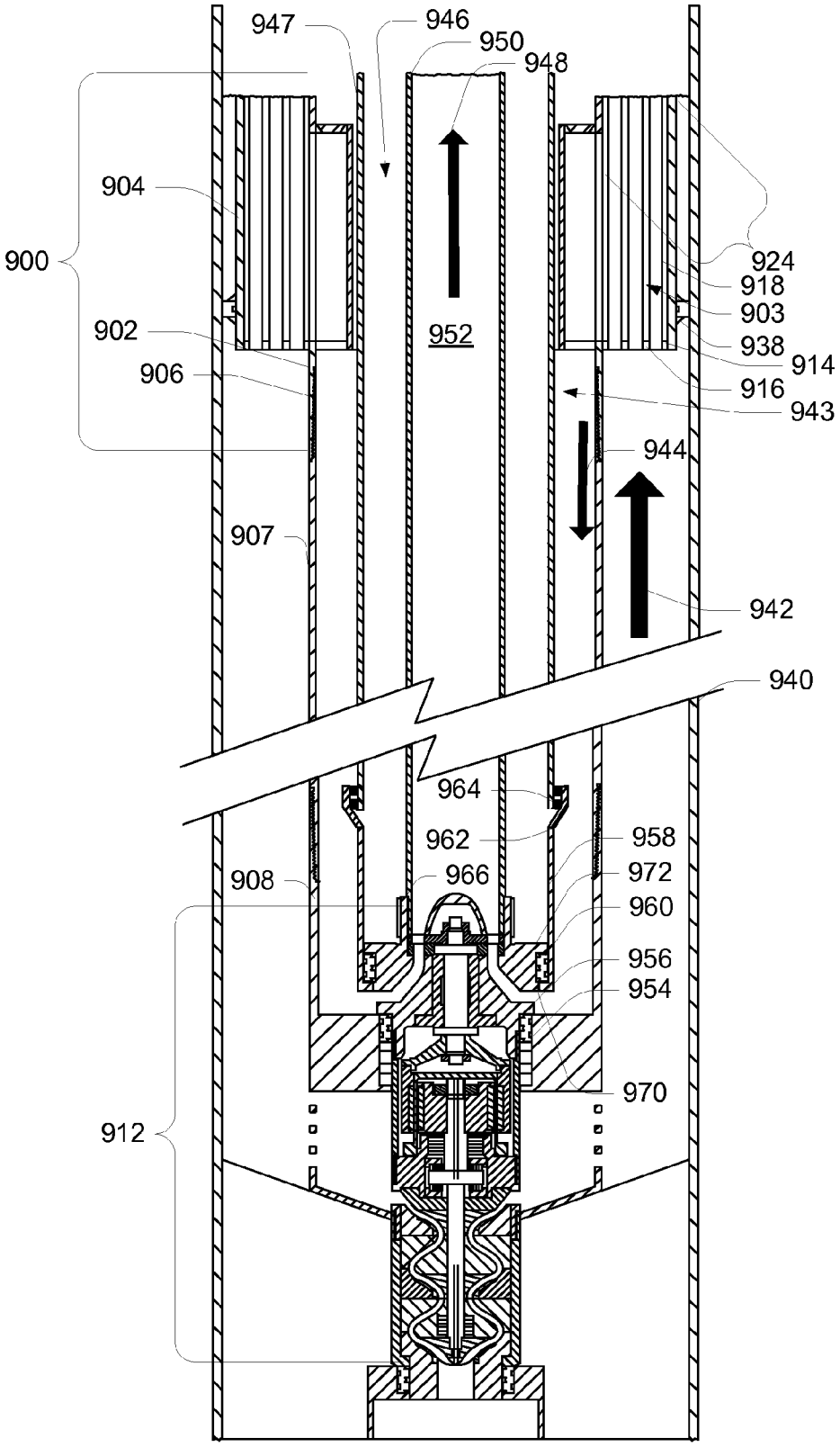
FIG. 9 is a longitudinal cross-sectional schematic drawing of a lower most section of a subsurface heat exchanger connected to a subsurface turbine pump in accordance with an example embodiment of the invention.

FIG. 9 is a longitudinal cross-sectional schematic drawing of a lower-most section of a subsurface heat exchanger connected to a subsurface turbine pump in accordance with an example embodiment of the invention. A subsurface heat exchanger section 900 (of which only a portion is shown) has an inner shell 902 and an outer shell 904. The inner shell 902 has a lower threaded portion 906 that threadably connects the subsurface heat exchanger section 900 to an upper end of a casing string 907 thus forming a threaded casing interconnection joint. A lower end of the casing string 907 is threadably connected to a subsurface turbine pump receiving receptacle 908.

The subsurface heat exchanger section 900 includes a lower annular ring 914 that extends outwardly from an outer surface of the upper threaded portion 906 of the inner shell 902 to an inner surface of the outer shell 904. The upper annular ring 914 has one or more openings 916 to which one or more heat exchanger tubes 918 are sealably connected at a respective first end of each of the heat exchanger tubes 918. An upper annular ring (not shown) extends outwardly from an outer surface of an upper threaded portion (not shown) of the inner shell 902. The upper annular ring (not shown) has one or more openings to which the one or more heat exchanger tubes 918 are sealably connected at a respective second end of each of the heat exchanger tubes 918. As such, the lower annular ring 914 and the upper annular ring (not shown) form two face plates with the heat exchanger tubes 918 extending therebetween thus defining a heat exchanger tubing bundle 924 passing through an annular chamber 903 defined between the inner shell 902 and the outer shell 904.

One or more annular seals 938 are located on an outer surface of the outer shell 904 and form a complete or partial seal between the outer surface of the outer shell 904 and the inner surface of a wellbore casing 940. When a first fluid, such as heated fluid from a production zone of a geothermal well, flows upward as indicated by flow arrow 942, the one or more annular seals 938 divert the fluid, either completely or partially, into an interior portion of the heat exchanger tubing bundle 924 of the subsurface heat exchanger section 900.

A second fluid, such as a working fluid for a subsurface turbine pump 912, flows downwardly in an annular flow channel 943 defined by the inner surface of the inner shell 902 and the outer surface of an internal casing string 947, as indicated by flow arrow 944, and flows around outer surfaces of the one or more heat exchanger tubes 918.

As described above, the lower annular ring 914 and the upper annular ring (not shown) form two face plates with the heat exchanger tubes 918 extending therebetween thus defining a heat exchanger tubing bundle 924 passing through the annular chamber 903 defined between the inner shell 902 and the outer shell 904. The inner shell 902 also defines an open inside diameter 946 that extends through the length of the subsurface heat exchanger section 900. The internal casing string 947 extends through the open inside diameter 946. The internal casing string 947 may be used as an additional flow channel for return of a working fluid. In addition, an additional casing string 950 can pass through an interior of the internal casing string 947 thus defining another flow channel 952 that is used as an exhaust for the return of the working fluid flowing through and powering the subsurface turbine pump 912. In addition, the internal casing string 947 and the annulus 946 allow for insertion and removal of the subsurface turbine pump 912.

The subsurface turbine pump receiving receptacle 908 includes a set of static seals 954 that sealably connect the subsurface turbine pump 912 to the subsurface turbine pump receiving receptacle 908. The subsurface turbine pump receiving receptacle 908 also provides support to the subsurface turbine pump 912 at a lower flange 956 of the subsurface turbine pump 912.

The subsurface turbine pump receiving receptacle 908 includes an inner portion 958 that is connected to the subsurface turbine pump 912 by an additional set of static seals 960 at a lower end of the inner portion 958. The inner portion 958 includes an upper seal receptacle 962 at an upper end of the inner portion 958. The upper seal receptacle 962 mates with a sealing member 964 located at a lower end of the internal casing string 947.

To place the subsurface turbine pump 912 into position, the subsurface turbine pump receiving receptacle 908 is threadably attached to the casing string 907. The casing string 907 is then attached to the lower threaded portion 906 of the subsurface heat exchanger section 900. Once the subsurface heat exchanger section 900 is set, the internal casing string 947 is stabbed into place into the upper seal receptacle 962 of the inner portion 958 of the subsurface turbine pump receiving receptacle 908. The subsurface turbine pump 912 is attached to the casing string 950 and dropped into position, mating with the subsurface turbine pump receiving receptacle 908.

When the subsurface turbine pump 912 is placed into the subsurface turbine pump receiving receptacle 908, the subsurface turbine pump 912 preloads the static seals 954 using the lower flange 956 that passes through a lower opening 970 of the inner portion 958 of the subsurface turbine pump receiving receptacle 908 as the lower flange 956 is smaller in diameter than then the lower opening 970. The subsurface turbine pump 912 also includes an upper flange 972 that is larger in diameter than the lower opening 970. The upper flange 972 preloads the static seal 960 located in the inner portion 958 of the subsurface turbine pump receiving receptacle 908 when the subsurface turbine pump 912 is placed into position.

To remove the subsurface turbine pump 912, the subsurface turbine pump 912 is lifted out of the subsurface turbine pump receiving receptacle 908 by lifting up on the casing string 950 and pulling the subsurface turbine pump 912 through the open inside diameter 946 of the subsurface heat exchanger section 900.

Figure 10:
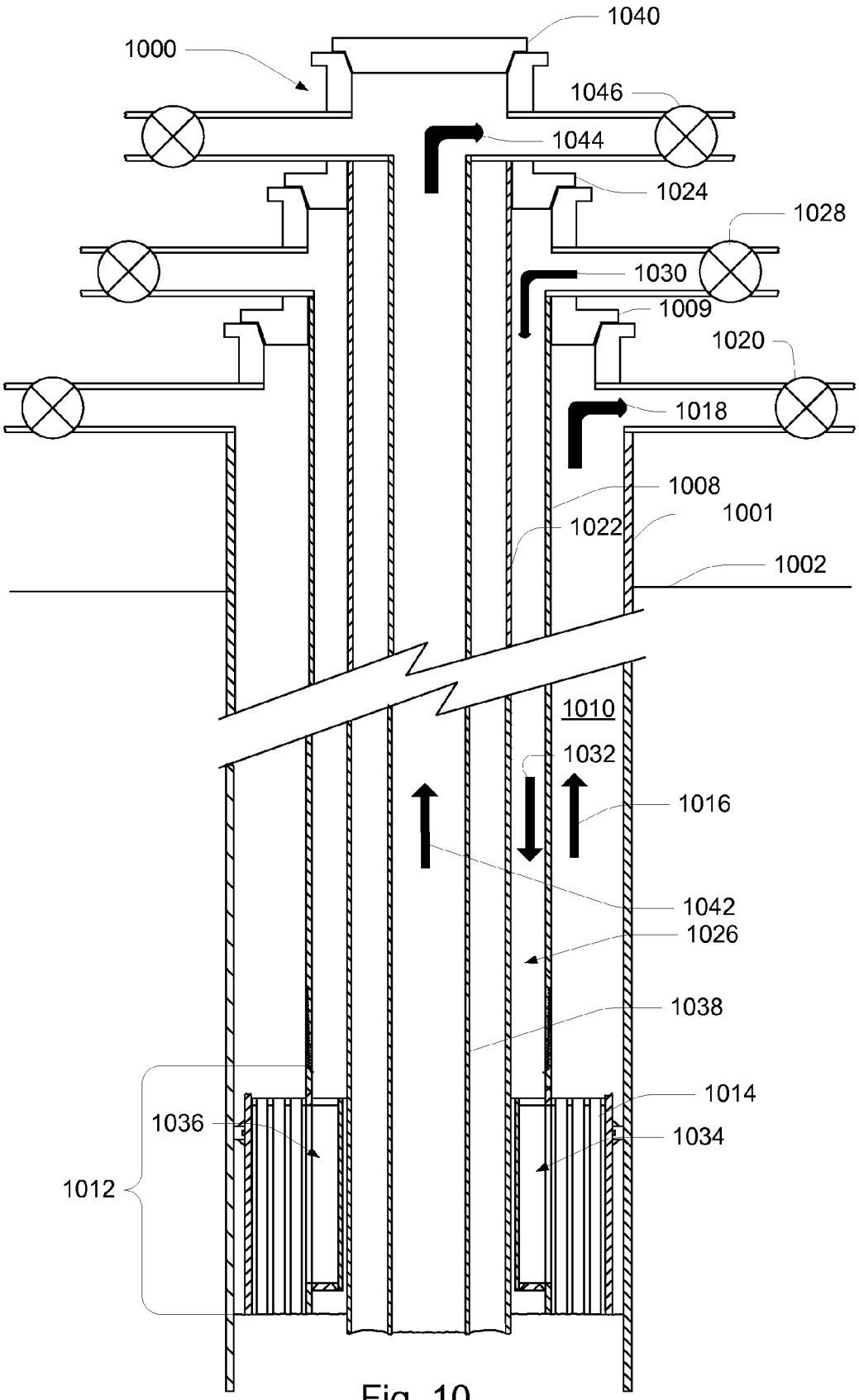
FIG. 10 is a longitudinal cross-sectional schematic drawing of a surface completion at a wellhead in accordance with an example embodiment of the invention.

FIG. 10 is a longitudinal cross-sectional schematic drawing of a surface completion at a wellhead 1000 in accordance with an example embodiment of the invention. The wellhead 1000 includes a wellbore casing 1001 that extends from the surface 1002 into a wellbore. A first casing string 1008 is hung from a first casing hanger 1009 and extends downward through an interior of the wellbore casing 1001, defining a first annular flow channel 1010 between an outer surface of the first casing string 1008 and an inner surface of the wellbore casing 1001. A lower end of the first casing string 1008 is connected to an uppermost subsurface heat exchanger section 1012 (of which only a portion is shown). The first annular flow channel 1010 receives heated fluid that flows from a tubing bundle 1014 of the uppermost subsurface heat exchanger section 1012, as indicated by flow arrows 1016 and 1018. The heated fluid flows to the surface 1002 and through a valve 1020 of the wellhead 1000.

A second casing string 1022 is hung by a second casing hanger 1024 and extends through an interior of the first casing string 1008. A second annular flow channel 1026 is defined by the exterior surface the second casing string 1022 and an interior surface of the first casing string 1008. Working fluid is introduced into a valve 1028 of the wellhead 1000 and flows downward through the second annular flow channel 1026, as indicated by flow arrows 1030 and 1032, and into one or more inlet boxes, such as inlet boxes 1034 and 1036, of the uppermost heat exchanger section 1012.

A third casing string 1038 is hung by a third casing hanger 1040 and extends through the interior of the second casing string 1022. Expanded working fluid returning to the surface 1002 from a subsurface device (not shown) flows upward through the third casing string 1038, as indicated by flow arrows 1042 and 1044, and out through a valve 1046 of the wellhead 1000.

While the invention has been shown and described with respect to example embodiments thereof, it will be understood by those skilled in the art that changes in form and details may be made to these embodiments without departing from the scope and spirit of the invention.

What is claimed is:

1. A well completion system comprising a subsurface heat exchanger section that includes:

an outer shell extending longitudinally the length of each heat exchanger section along an axis;

an inner shell extending longitudinally along the axis and having an upper connector, an open inside diameter, one or more inlet boxes, and one or more outlet boxes, and wherein an annular cavity is defined between the outer shell and the inner shell extending longitudinally therebetween;

an upper annular ring radially extending between the inner shell and the outer shell, the upper annular ring having one or more openings therethrough;

a lower annular ring radially extending between the inner shell and the outer shell and longitudinally spaced apart from the upper annular ring, the lower annular ring having one or more openings therethrough and connected to the upper annular ring via the inner shell and the outer shell; and one or more tubes sealably connected at a first end and a second end to the one or more openings in the upper annular ring and the one or more openings in the lower annular ring, respectively, the one or more tubes extending between the upper and lower annular rings and through the annular cavity.

2. The well completion system of claim 1, further comprising an interior casing passing through the open inside diameter of the inner shell, the interior casing having an opening for coupling to a subsurface pump.

3. The well completion system of claim 1, wherein at least one of the one or more inlet boxes and at least one of the one or more outlet boxes partially form the annular cavity.

4. The well completion system of claim 1, wherein the upper connector is an upper threaded portion.

5. The well completion system of claim 4, wherein the subsurface heat exchanger section is threadably coupled by the upper threaded portion to an upper casing string.

6. The well completion system of claim 4, wherein the subsurface heat exchanger section is threadably coupled to another subsurface heat exchanger section by the upper threaded portion.

7. The well completion system of claim 4, wherein the inner shell further includes a lower threaded portion.

8. The well completion system of claim 7, wherein the subsurface heat exchanger is threadably coupled to a lower casing string by the lower threaded portion.

9. The well completion system of claim 7, wherein the subsurface heat exchanger is threadably coupled to another heat exchanger section by the lower threaded portion.

10. A well completion system comprising a heat exchanger section including:

an outer shell extending longitudinally the length of each heat exchanger section along an axis;

an inner shell extending longitudinally along the axis and including an open inside diameter, an upper connector, a lower connector, one or more inlet boxes, and one or more outlet boxes, the inner shell passing through an open inside diameter of the outer shell, and wherein an annular cavity is defined between the outer shell and the inner shell extending longitudinally therebetween;

an upper annular ring extending radially between the inner shell and the outer shell, the upper annular ring having one or more openings therethrough;

a lower annular ring extending radially between the inner shell and the outer shell and longitudinally spaced apart from the upper annular ring, the lower annular ring having one or more openings therethrough and connected to the upper annular ring via the inner shell and the outer shell, and one or more tubes sealably connected at a first end and a second end to the one or more openings in the upper annular ring and the one or more openings in the lower annular ring, respectively, the one or more tubes extending between the upper and lower annular rings and through the annular cavity;

an upper casing string coupled to the heat exchanger section at the upper connector;

a lower casing string coupled to the heat exchanger section at the lower connector; and an interior casing passing through the open inside diameter of the inner shell of the heat exchanger section, the interior casing having an end opening for coupling to a subsurface pump.

11. The well completion system of claim 10, wherein at least one of the one or more inlet boxes and at least one of the one or more outlet boxes partially form the annular cavity.

12. A subsurface heat exchanger comprising:

a first subsurface heat exchanger section including a first inner shell extending longitudinally along an axis, a first outer shell extending longitudinally the length of the first heat exchanger section along the axis and defining a first annular cavity between the first inner shell and the first outer shell, and a first tubing bundle extending through the first annular cavity, the first inner shell having: a first open inside diameter, a first lower connector, a first one or more inlet boxes, and a first one or more outlet boxes, the first inner shell passing through an open inside diameter of the first outer shell; and a second subsurface heat exchanger section including a second inner shell extending longitudinally along an axis, a second outer shell extending longitudinally the length of the second heat exchanger section along the axis and defining a second annular cavity between the second inner shell and the second outer shell, and a second tubing bundle extending through the second annular cavity, the second inner shell having: a second open inside diameter, a first upper connector, a second one or more inlet boxes, and a second one or more outlet boxes, wherein the first subsurface heat exchanger section and the second subsurface heat exchanger section are coupled together at the first lower connector and the first upper connector, wherein the first open inside diameter and the second open inside diameter form a contiguous open inside diameter through the subsurface heat exchanger, and wherein the first one or more outlet boxes of the first subsurface heat exchanger section is or are coupled to the second one or more inlet boxes of the second subsurface heat exchanger section so that the inlet and outlet boxes are contiguous.

13. The subsurface heat exchanger of claim 12, wherein the second subsurface heat exchanger section further includes a second lower connector, wherein the subsurface heat exchanger further comprises a third subsurface heat exchanger section including a third inner shell, a third outer shell, and a third tubing bundle positioned therebetween, the third inner shell having a third open inside diameter, a second upper connector, a third one or more inlet boxes, and a third one or more outlet boxes, wherein the second subsurface heat exchanger section and the third subsurface heat exchanger section are coupled together at the second lower connector and the second upper connector, wherein the first open inside diameter, the second open inside diameter, and the third open inside diameter form a contiguous open inside diameter through the subsurface heat exchanger, and wherein the second one or more outlet boxes of the second subsurface heat exchanger section are coupled to the third one or more inlet boxes of the third subsurface heat exchanger section.

14. The subsurface heat exchanger of claim 13, wherein the first lower connector, the first upper connector, the second lower connector and the second upper connector include threaded portions.

15. The subsurface heat exchanger of claim 12, wherein the first inner shell of the first subsurface heat exchanger section further includes a second upper connector for coupling to an upper casing string.

16. The subsurface heat exchanger of claim 15, wherein the second upper connector includes a threaded portion.

17. The subsurface heat exchanger of claim 12, wherein the second inner shell of the second subsurface heat exchanger section further includes a second lower connector for coupling to a lower casing string.

18. The subsurface heat exchanger of claim 17, wherein the second lower connector includes a threaded portion.

19. The subsurface heat exchanger of claim 12, wherein the first one or more outlet boxes and the first one or more inlet boxes form at least a portion of a flow channel around the upper connector and the lower connector and around the first and second tubing bundles.

20. The subsurface heat exchanger of claim 12, wherein the first one or more outlet boxes is or are defined in part by the lower connector and the second one or more inlet boxes is or are defined in part by the upper connector.

21. The subsurface heat exchanger of claim 12, wherein the first lower connector and the first upper connector include threaded portions.

* * * * *